US011571900B2

(12) United States Patent
Utzui

(10) Patent No.: US 11,571,900 B2
(45) Date of Patent: Feb. 7, 2023

(54) PRINTING APPARATUS AND CONTROL METHOD

(71) Applicant: CANON KABUSHIKI KAISHA, Tokyo (JP)

(72) Inventor: Syuu Utzui, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/364,538

(22) Filed: Jun. 30, 2021

(65) Prior Publication Data

US 2022/0009232 A1 Jan. 13, 2022

(30) Foreign Application Priority Data

Jul. 10, 2020 (JP) ..... JP2020-119452

(51) Int. Cl.
*B41J 2/165* (2006.01)
*B41J 29/38* (2006.01)

(52) U.S. Cl.
CPC ..... *B41J 2/16523* (2013.01); *B41J 2/16505* (2013.01); *B41J 29/38* (2013.01); *B41J 2002/16582* (2013.01)

(58) Field of Classification Search
CPC .... B41J 2/16523; B41J 2/16505; B41J 29/38; B41J 2002/16582; B41J 2/16508; B41J 2/16526
See application file for complete search history.

(56) References Cited

U.S. PATENT DOCUMENTS 5,838,343 A * 11/1998 Chapin ..... B41J 2/04 347/42

FOREIGN PATENT DOCUMENTS

JP 2008-221796 9/2008

* cited by examiner

*Primary Examiner* — Geoffrey S Mruk
(74) *Attorney, Agent, or Firm* — Venable LLP

(57) ABSTRACT

A printing apparatus comprises: a printing unit configured to print onto a sheet by ejecting ink from a printing head; a maintenance unit configured to perform a maintenance operation capable of being performed in parallel with the printing performed by the printing unit; and a control unit configured to control the maintenance unit such that when the printing by the printing unit and the maintenance operation by the maintenance unit are performed in parallel, and the maintenance operation is not completed by the time the printing by the printing unit has ended, the maintenance operation is ended without being completed.

15 Claims, 18 Drawing Sheets

FIG. 3A

300

| CAP-RETAINED INK COUNTER |
| --- |
| AMOUNT OF INK (pl) |
| 0 |

FIG. 3B

300

| CAP-RETAINED INK COUNTER |
| --- |
| AMOUNT OF INK (pl) |
| 24000 |

FIG. 4

400

| INK REMOVAL SUCTION OPERATION SEQUENCE TABLE | |
| --- | --- |
| DRIVE SPEED (pps) | TOTAL DRIVE AMOUNT (pls) |
| 1000 | 15000 |

401 402

FIG. 5A

500

| INK REMOVAL SUCTION OPERATION PROGRESS TABLE | |
|---|---|
| DRIVE SPEED (pps) | DRIVE AMOUNT (pls) |
| 0 | 0 |

501 502

FIG. 5B

500

| INK REMOVAL SUCTION OPERATION PROGRESS TABLE | |
|---|---|
| DRIVE SPEED (pps) | DRIVE AMOUNT (pls) |
| 1000 | 15000 |

501 502

FIG. 5C

500

| INK REMOVAL SUCTION OPERATION PROGRESS TABLE | |
|---|---|
| DRIVE SPEED (pps) | DRIVE AMOUNT (pls) |
| 1000 | 7000 |

501 502

FIG. 11

1100

1102

1101

1103

| INK REMOVAL SUCTION OPERATION SEQUENCE TABLE | | |
|---|---|---|
| STEP | DRIVE SPEED (pps) | DRIVE AMOUNT (pls) |
| 0 | 3000 | 1500 |
| 1 | 3000 | 1500 |
| 2 | 3000 | 1500 |
| 3 | 3000 | 1500 |
| 4 | 3000 | 1500 |
| 5 | 3000 | 1500 |
| 6 | 3000 | 1500 |
| 7 | 3000 | 1500 |
| 8 | 3000 | 1500 |
| 9 | 3000 | 1500 |
| 10 | 3000 | 1500 |

FIG. 16A

1600

| CAP-RETAINED INK COUNTER |
| --- |
| AMOUNT OF INK (dot) |
| 0 |

FIG. 16B

1600

| CAP-RETAINED INK COUNTER |
| --- |
| AMOUNT OF INK (dot) |
| 6000 |

PRINTING APPARATUS AND CONTROL METHOD

BACKGROUND OF THE INVENTION

Field of the Invention

The present invention relates to a printing apparatus capable of executing maintenance operations, and to a control method.

Description of the Related Art

An ink jet printer sometimes performs maintenance operations at the start of printing or during printing operations. Maintenance operations include flushing (preliminary discharge), for example, which is done to prevent nozzle clogs from forming in the printing head and discharge ink that has thickened by remaining in the printing head. Flushing is performed using a dedicated waste ink receptacle or a cap that protects the printing head. Ink discharged into the cap thickens due to evaporation the longer the ink remains in the cap. Accordingly, ink removal suction operations for the purpose of removing the ink from within the cap are performed as maintenance operations.

Japanese Patent Laid-Open No. 2008-221796 describes calculating an amount of ink held within a cap during printing operations and an amount of ink expected to be discharged into the cap by flushing involved in printing operations to be performed in the future. When a threshold is exceeded, ink removal suction operations are performed to discharge the ink held in the cap.

SUMMARY OF THE INVENTION

The present invention provides a printing apparatus and control method that prevent ink removal suction operations from affecting printing progress.

The present invention in one aspect provides a printing apparatus comprising: a printing unit configured to print onto a sheet by ejecting ink from a printing head; a maintenance unit configured to perform a maintenance operation capable of being performed in parallel with the printing performed by the printing unit; and a control unit configured to control the maintenance unit such that when the printing by the printing unit and the maintenance operation by the maintenance unit are performed in parallel, and the maintenance operation is not completed by the time the printing by the printing unit has ended, the maintenance operation is ended without being completed.

According to the present invention, ink removal suction operations can be prevented from affecting printing operations.

Further features of the present invention will become apparent from the following description of exemplary embodiments with reference to the attached drawings.

BRIEF DESCRIPTION OF THE DRAWINGS

FIGS. 3A and 3B are diagrams illustrating a cap-retained ink counter.

FIG. 4 is a diagram illustrating an ink removal suction operation sequence table.

FIGS. 5A, 5B, and 5C are diagrams illustrating an ink removal suction operation progress table.

FIG. 11 is a diagram illustrating an ink removal suction operation sequence table.

FIGS. 16A and 16B are diagrams illustrating a cap-retained ink counter.

DESCRIPTION OF THE EMBODIMENTS

Figure 1:
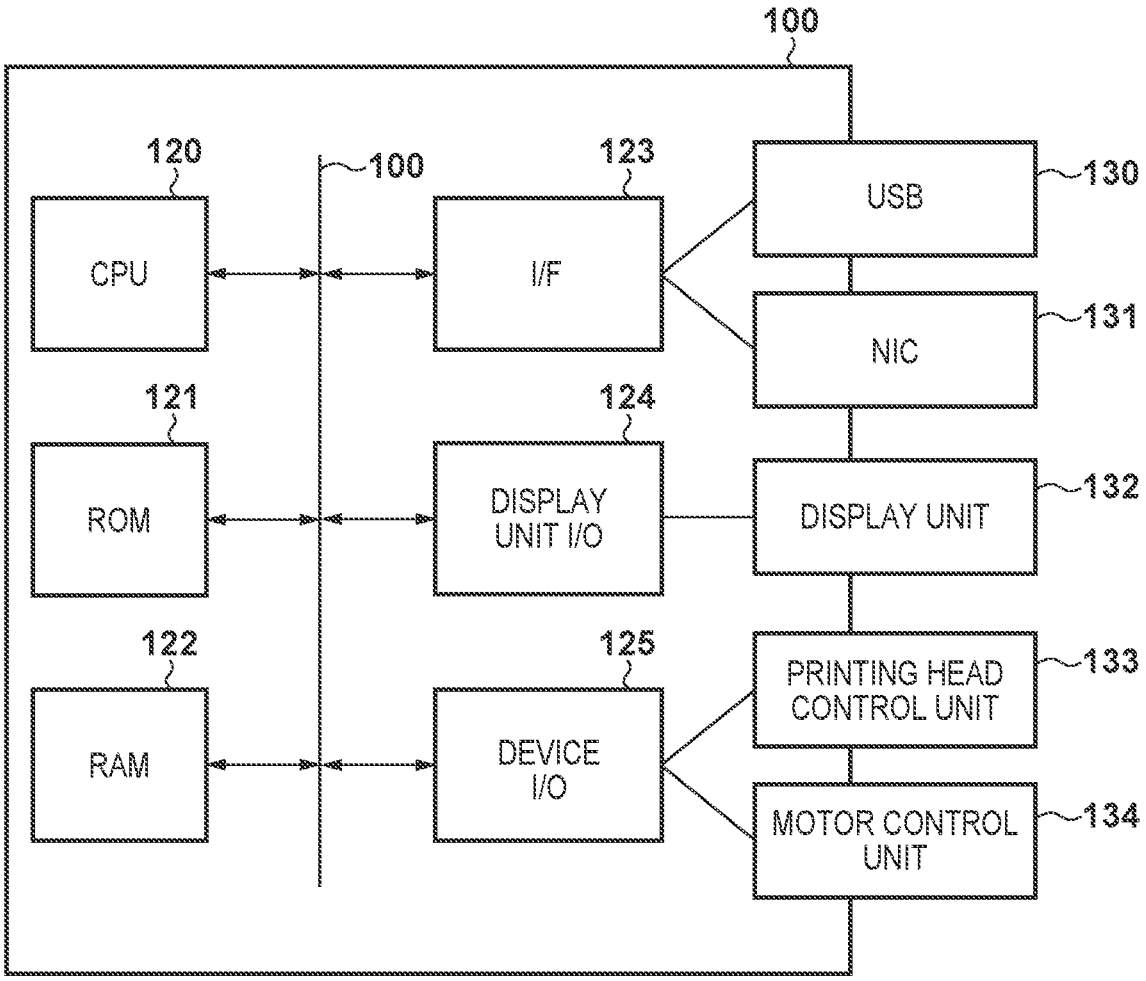
FIG. 1 is a block diagram illustrating the configuration of a control system of a printer.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

Executing the ink removal suction operations before printing is started as in Japanese Patent Laid-Open No. 2008-221796 will delay the start of printing. In this case, it is conceivable to configure the apparatus such that the ink removal suction operations can be performed in parallel with printing. However, even if the apparatus is configured such that the ink removal suction operations can be performed in parallel with printing, if the ink removal suction operations are still underway when printing ends, it will be necessary to wait for the ink removal suction operations to end. The execution of ink removal suction operations may therefore affect the progress of printing.

According to one aspect of the present invention, the ink removal suction operations can be prevented from affecting printing operations.

First Embodiment

FIG. 1 is a block diagram illustrating the configuration of a control system of a printer according to the present embodiment. A printer (printing apparatus) according to the present embodiment is an ink jet printer (ink jet recording apparatus) that uses an ink jet recording method to record by ejecting ink droplets onto a sheet serving as a recording medium. The present embodiment will describe an ink jet printer that uses a serial printing head capable of moving back and forth in a direction intersecting with a sheet transport direction. In a control system 100, a CPU 120, ROM 121, RAM 122, an interface (I/F) 123, a display unit I/O 124, and a device I/O 125 are connected to a local bus 110 and can communicate with each other. A USB 130 and a Network Interface Card (NIC) 131 are connected to the I/F 123. A wireless LAN or other communication interface may also be connected to the I/F 123. A display unit 132 capable of displaying various types of user interface screens is connected to the display unit I/O 124. The display unit 132 includes an operation accepting unit, such as physical keys, and can accept user operations. A touch panel capable of accepting user operations may be configured as the operation accepting unit. A printing head control unit 133, a motor control unit 134, and the like are connected to the device I/O 125. The printing head control unit 133 controls the ejection of ink droplets from nozzles (not shown) of the printing head and the movement of a carriage (not shown) on which the printing head is mounted, for example. The motor control unit 134 controls the driving of, for example, a motor for moving the carriage on which the printing head is mounted, a motor for transporting and feeding sheets, and a motor for maintenance operations of the printing head.

Figure 2:
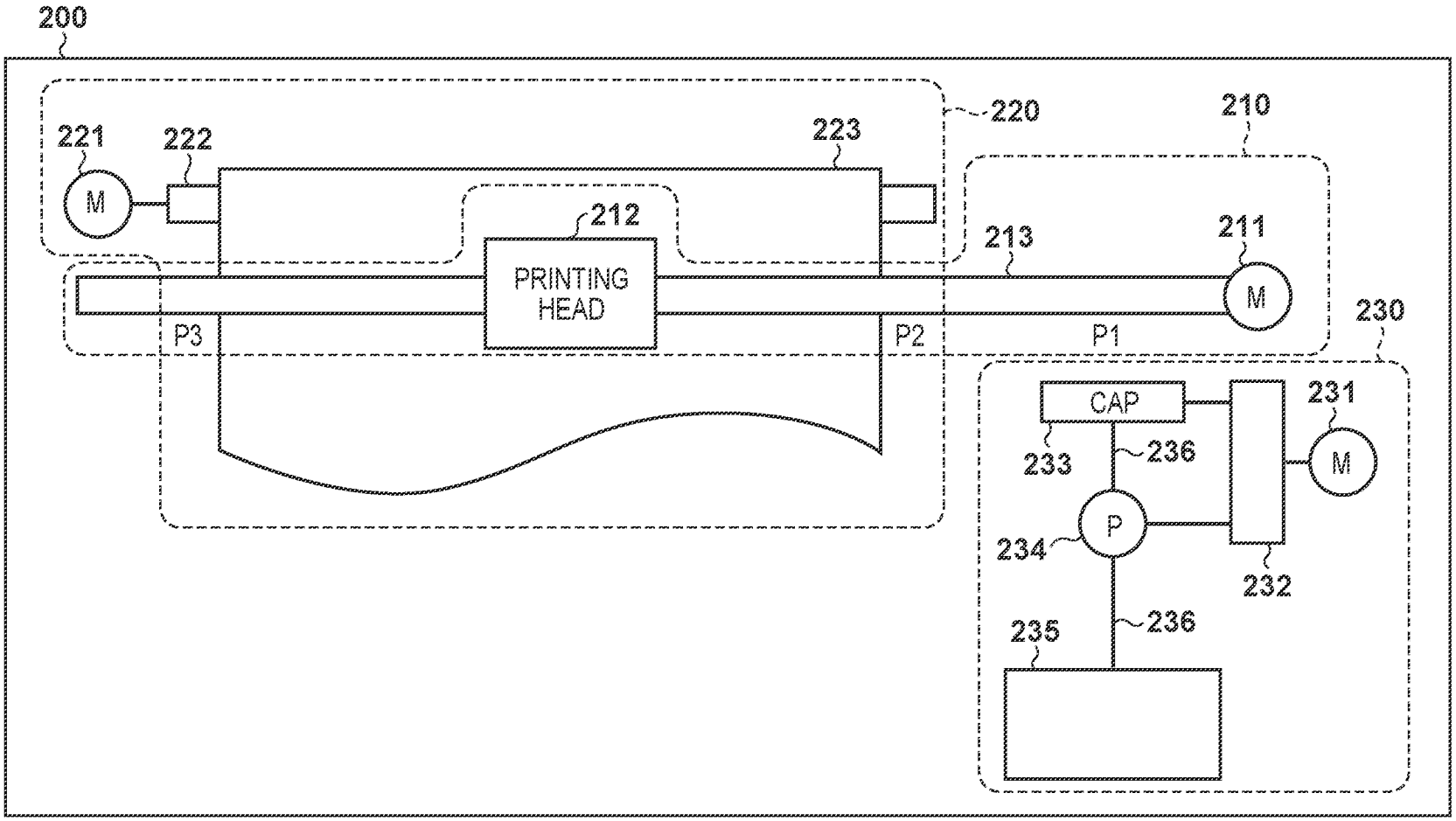
FIG. 2 is a diagram illustrating the configuration of devices in the periphery of a printing head of the printer.

FIG. 2 is a diagram illustrating the configuration of devices in the periphery of a printing head of a printer 200. The printer 200 represents the overall apparatus, and the control system 100 in FIG. 1 is included in the printer 200. FIG. 2 illustrates a printing head control device 210, a sheet control device 220, and a recovery control device 230 as the configuration of devices in the periphery of the printing head of the printer 200. The printing head control device 210 includes a motor 211 and a printing head 212, and the position of the printing head 212 in a scanning direction is controlled by a drive device 213 and the motor 211. Although not illustrated in FIG. 2, the printing head 212 is mounted on the carriage. A position P1 is a position for performing recovery operations (maintenance operations) of the printing head 212. A position P2 is a recording start position for the printing head 212. A position P3 is a recording end position for the printing head 212.

In the sheet control device 220, a paper feed roller 222 is connected to a motor 221, and a position of a sheet 223 in the transport direction is controlled. In the recovery control device 230, a drive switching device 232 is connected to a motor 231, and the control of a cap 233 and a pump 234 can be switched according to a drive direction of the motor 231. An ink flow channel 236 for sending ink to a waste ink reservoir 235 via the pump 234 is connected to the cap 233. When the printer 200 is powered off, or is powered on but is not operating, the printing head 212 moves to the position P1 and is protected by the cap 233. Note that the configuration may be such that the cap 233 and the pump 234 are controlled separately, rather than providing the drive switching device 232. The printing head 212 in FIG. 2 is controlled by the printing head control unit 133 in FIG. 1, and the motors 211, 221, and 231 in FIG. 2 are controlled by the motor control unit 134 in FIG. 1.

The following will describe a case where a plurality of pages are printed, and a case where two pages are printed in particular, as an example of printing operations according to the present embodiment. In the flow of maintenance operations according to the present embodiment, printing of the first page is started, and a flushing execution determination, flushing, and printing operations are repeated thereafter. Then, when the amount of ink discharged into the cap 233 by the flushing exceeds a threshold, ink removal suction operations are started in parallel with the printing (printing-parallel maintenance operation). If the ink removal suction operations are underway at the time when the printing of the first page ends, the ink removal suction operations are suspended. The ink removal suction operations are resumed in parallel with the printing of the second page, and when the printing of the second page ends, the apparatus waits for the ink removal suction operations to complete and then ends the printing. Such a configuration makes it possible to prevent a situation where the print start timing or print end timing is delayed due to the apparatus standing by for the completion of the ink removal suction operations when printing starts or when the printing of a page aside from the final page ends.

FIGS. 3A and 3B are diagrams illustrating an example of a cap-retained ink counter 300. FIG. 3A illustrates an initial state. The cap-retained ink counter 300 is stored, for example, in the ROM 121, the RAM 122, or the like of the control system 100. When ink is ejected from nozzles (not shown) in the printing head 212 and discharged into the cap 233 through flushing, a parameter of the cap-retained ink counter 300, indicating the amount of ink held in the cap 233, is updated. FIG. 3B illustrates a state in which the parameter of the cap-retained ink counter 300, indicating the amount of ink, has been updated.

FIG. 4 is a diagram illustrating an example of an ink removal suction operation sequence table 400. The ink removal suction operation sequence table 400 is stored, for example, in the ROM 121, the RAM 122, or the like of the control system 100. The ink removal suction operation sequence table 400 contains drive speed 401 and total drive amount 402 as parameters for performing the ink removal suction operations. Drive speed 401 indicates a maximum speed used when driving the motor 231. Total drive amount 402 indicates a total drive amount from when the motor 231 starts operating to when the motor 231 stops operating. The present embodiment assumes, for example, that the motor 231 is driven at a drive speed of 1,000 pps and a total drive amount of 15,000 pls. The unit "pps" is a drive amount of pulses per second, and the unit "pls" indicates the pulse drive amount in number of pulses.

FIGS. 5A, 5B, and 5C are diagrams illustrating an example of an ink removal suction operation progress table 500. The ink removal suction operation progress table 500 is stored, for example, in the ROM 121, the RAM 122, or the like of the control system 100. In the present embodiment, the ink removal suction operation progress table 500 has the same data structure as the ink removal suction operation sequence table 400 in FIG. 4. FIG. 5A illustrates an initial state, and values of drive speed 501 and drive amount 502 are all reset to zero. FIG. 5B illustrates the values when an ink removal suction operation start condition is satisfied and the driving of the motor 231 is started, and the values of the parameters in the ink removal suction operation sequence table 400 are stored. FIG. 5C illustrates an example of the values stored when the ink removal suction operations are suspended when the printing of the first page ends. For example, the motor 231 is driven at a drive speed of 1,000 pps for a drive amount of 8,000 pls when the printing of the first page ends. In this case, a value obtained by subtracting the above completed drive amount of 8,000 pls from the value of drive amount 502 in the ink removal suction operation progress table 500 in FIG. 5B is stored.

Operations of the present embodiment will be described next with reference to FIGS. 6 to 10.

Figure 6:
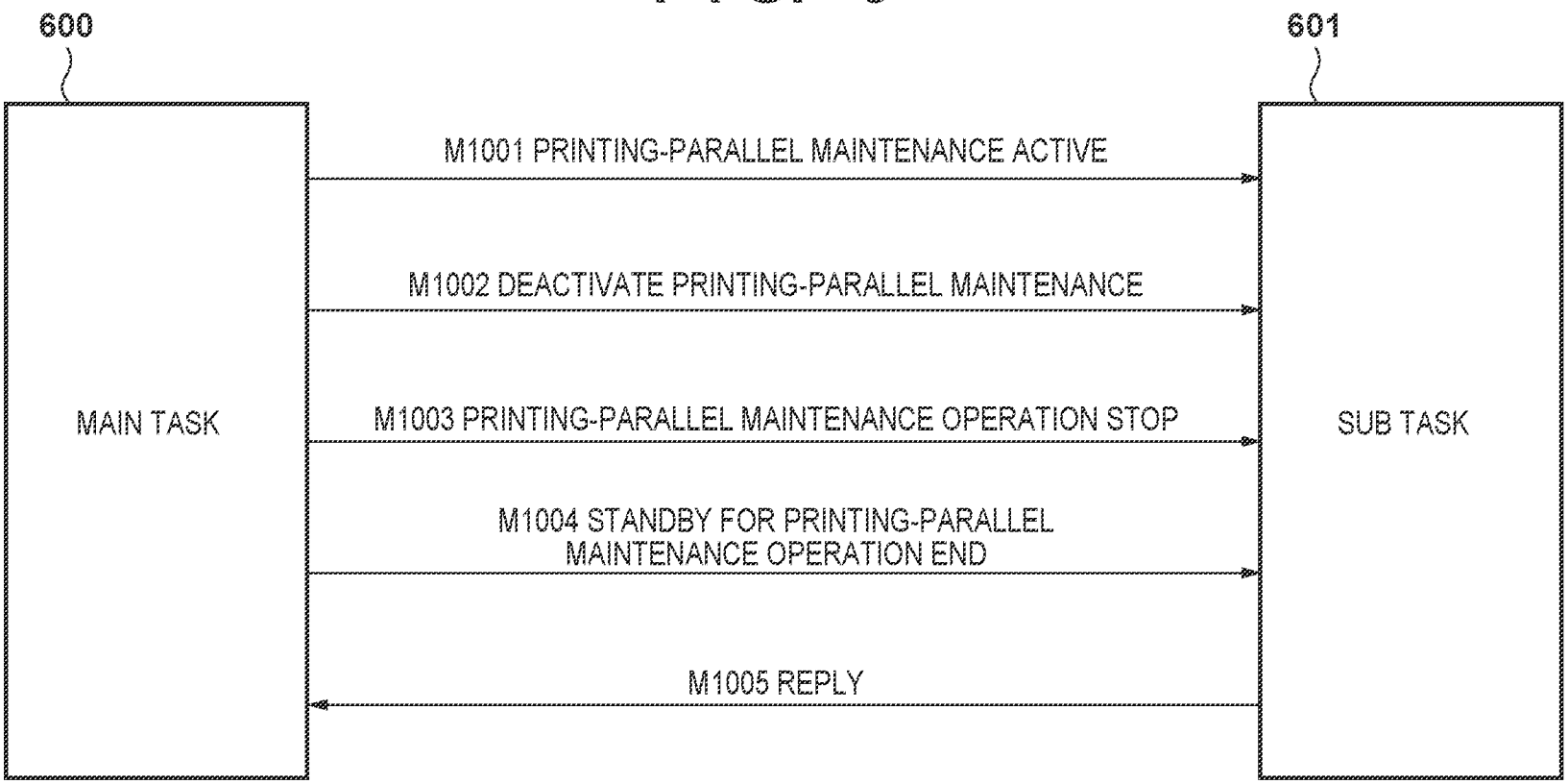
FIG. 6 is a diagram illustrating a task configuration.

FIG. 6 is a diagram illustrating a task configuration according to the present embodiment. In the present embodiment, a main task 600 and a sub task 601 run in the control system 100. In other words, the operations of the main task 600 and the sub task 601 are both realized by the CPU 120. Messages M1001, M1002, M1003, and M1004 are messages sent to the sub task 601 from the main task 600. The message M1001 is a message indicating that the printing-parallel maintenance operation is active (printing-parallel maintenance active). The message M1002 is a message indicating that the printing-parallel maintenance operation is inactive (printing-parallel maintenance inactive). The messages M1003 and M1004 are messages for controlling the ink removal suction operations during operations in the sub task 601. The message M1003 is a message for stopping the printing-parallel maintenance operation (printing-parallel maintenance operation stop). The message M1004 is a message for standing by for the end of the printing-parallel maintenance operation (printing-parallel maintenance operation end standby). After receiving the messages, performing the corresponding processing, and ending, the sub task 601 sends a reply M1005 to the main task 600.

Figure 7:
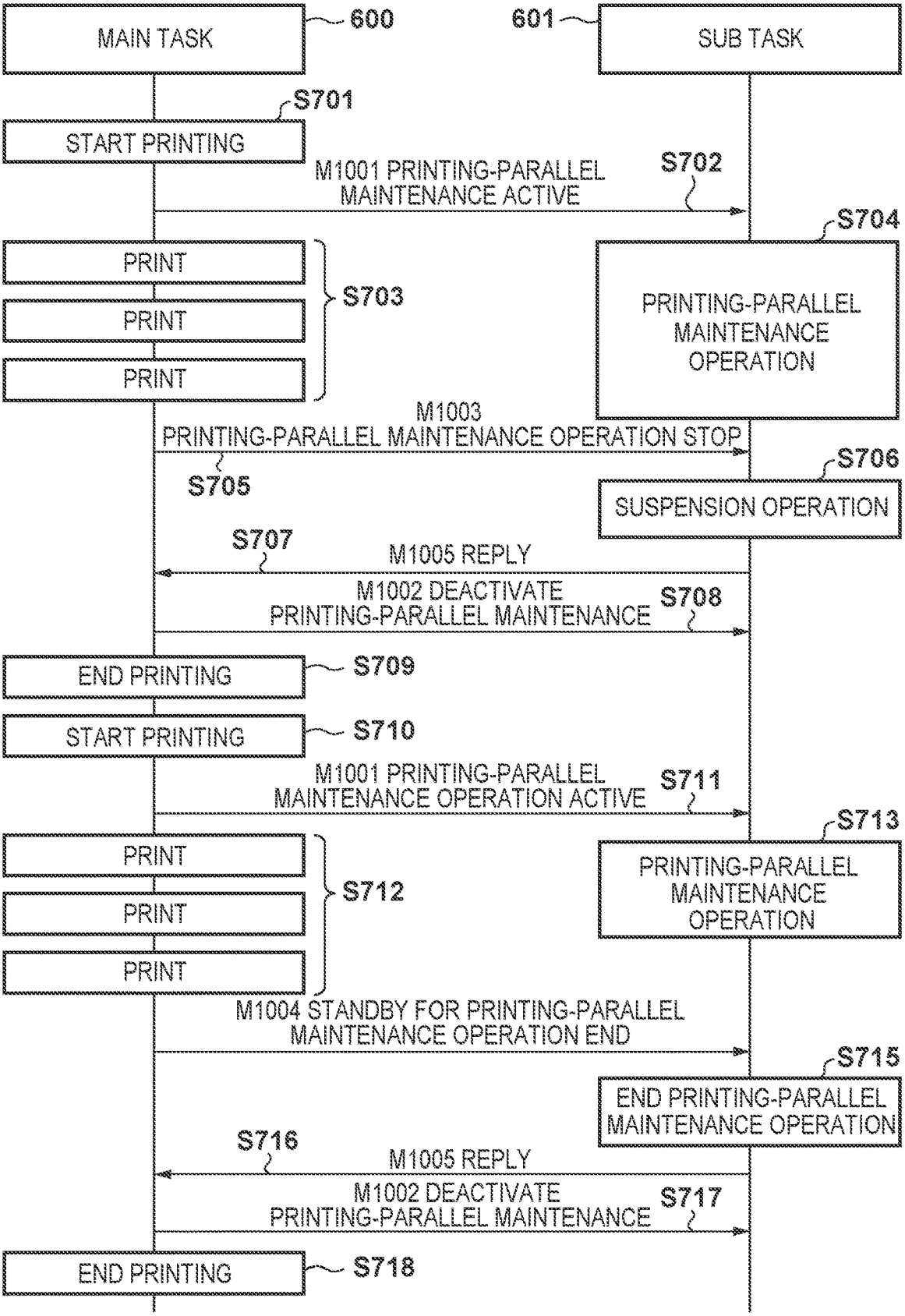
FIG. 7 is a diagram illustrating a sequence between a main task and a sub task.

FIG. 7 is a diagram illustrating a sequence between the main task 600 and the sub task 601. First, in step S701, the main task 600 starts the printing of the first page. At the start of printing, the main task 600 releases the cap 233 from the printing head 212 and moves the sheet 223. At the same time, the main task 600 performs flushing of the printing head 212 as a maintenance operation during printing. Waste ink is held in the cap 233 as a result of the flushing. Note that in the present embodiment, of the maintenance operations, a maintenance operation performed as an operation of the printing head 212 when printing onto the sheet 223 (e.g., flushing) is called a "maintenance operation during printing". On the other hand, a maintenance operation aside from a maintenance operation during printing, and which can be performed in parallel with the operations of the printing head 212 when printing onto the sheet 223, is called a "printing-parallel maintenance operation".

In step S702, the main task 600 activates the printing-parallel maintenance operation by sending the message M1001 (parallel-printing maintenance active) to the sub task 601. As a result of this activation, if an amount of waste ink produced by flushing in the maintenance during printing satisfies a condition, the driving of the pump 234 is started to remove the waste ink from the cap 233 as the printing-parallel maintenance operation. The printing-parallel maintenance operation is performed in parallel with the printing in step S703.

In step S703, the main task 600 forms an image by causing the printing head 212 to eject ink onto the sheet 223 while moving the printing head 212 from the position P2 to P3 or from the position P3 to P2. Once the printing operations by the printing head 212 end, the main task 600 moves the sheet 223. The above printing operations are performed once, or are repeated a plurality of times. Although FIG. 7 does not illustrate the maintenance operation during printing, the maintenance operation during printing may be performed if a condition is satisfied, such as a predetermined number of ejections having been reached.

Printing of the first page ends when the printing in step S703 ends. The main task 600 causes the sheet 223 to be discharged, and then suspends the printing-parallel maintenance operation by sending the message M1003 (printing-parallel maintenance operation stop) to the sub task 601. In step S706, the sub task 601 receives the message M1003, and stops the pump 234 if the pump 234 is operating. Then, in step S707, the sub task 601 sends the reply M1005 to the main task 600. In step S708, the main task 600 deactivates the printing-parallel maintenance operation by sending the message M1002 (printing-parallel maintenance inactive) to the sub task 601. Then, in step S709, the main task 600 ends the printing of the first page.

Next, in step S710, the main task 600 starts the printing of the second page. In step S711, the main task 600 activates the printing-parallel maintenance operation by sending the message M1001 (parallel-printing maintenance active) to the sub task 601. In the printing-parallel maintenance operation of step S713, the same operations are performed as with the first page. In the present embodiment, even if operations from the printing-parallel maintenance operation suspended earlier still remain, the sub task 601 resumes the driving of the pump 234 to perform the remainder of the printing-parallel maintenance operation.

In step S712, the same printing operations as those of step S703 are performed. Additionally, like step S703, the maintenance operation during printing may be performed when a condition is satisfied. Printing of the second page ends when the printing in step S712 ends. The main task 600 causes the sheet 223 to be discharged, and then stands by for the end of the printing-parallel maintenance operation performed by the sub task 601 by sending the message M1004 (printing-parallel maintenance operation end standby) to the sub task 601.

In step S715, the sub task 601 receives the message M1004, and completes the printing-parallel maintenance operation if the pump 234 is operating. In other words, unlike the first page, there is no subsequent page to be printed, and thus the printing-parallel maintenance operation is completed rather than being suspended. Then, in step S716, the sub task 601 sends the reply M1005 to the main task 600.

In step S717, the main task 600 deactivates the printing-parallel maintenance operation by sending the message M1002 (printing-parallel maintenance inactive) to the sub task 601. Then, in step S718, after the printing-parallel maintenance operation is complete, the main task 600 joins the cap 233 to the printing head 212, and the processing of FIG. 7 ends.

As described above, the printing-parallel maintenance operation is suspended if, when the printing of the first page ends, there is a subsequent page (e.g., a second page) to be printed. The remainder of the printing-parallel maintenance operation resulting from the suspension is performed in parallel with the printing of the second page. Such a configuration makes it possible to prevent a situation where the overall progress of processing for printing a plurality of pages is delayed due to the printing-parallel maintenance operation.

Figure 8A:
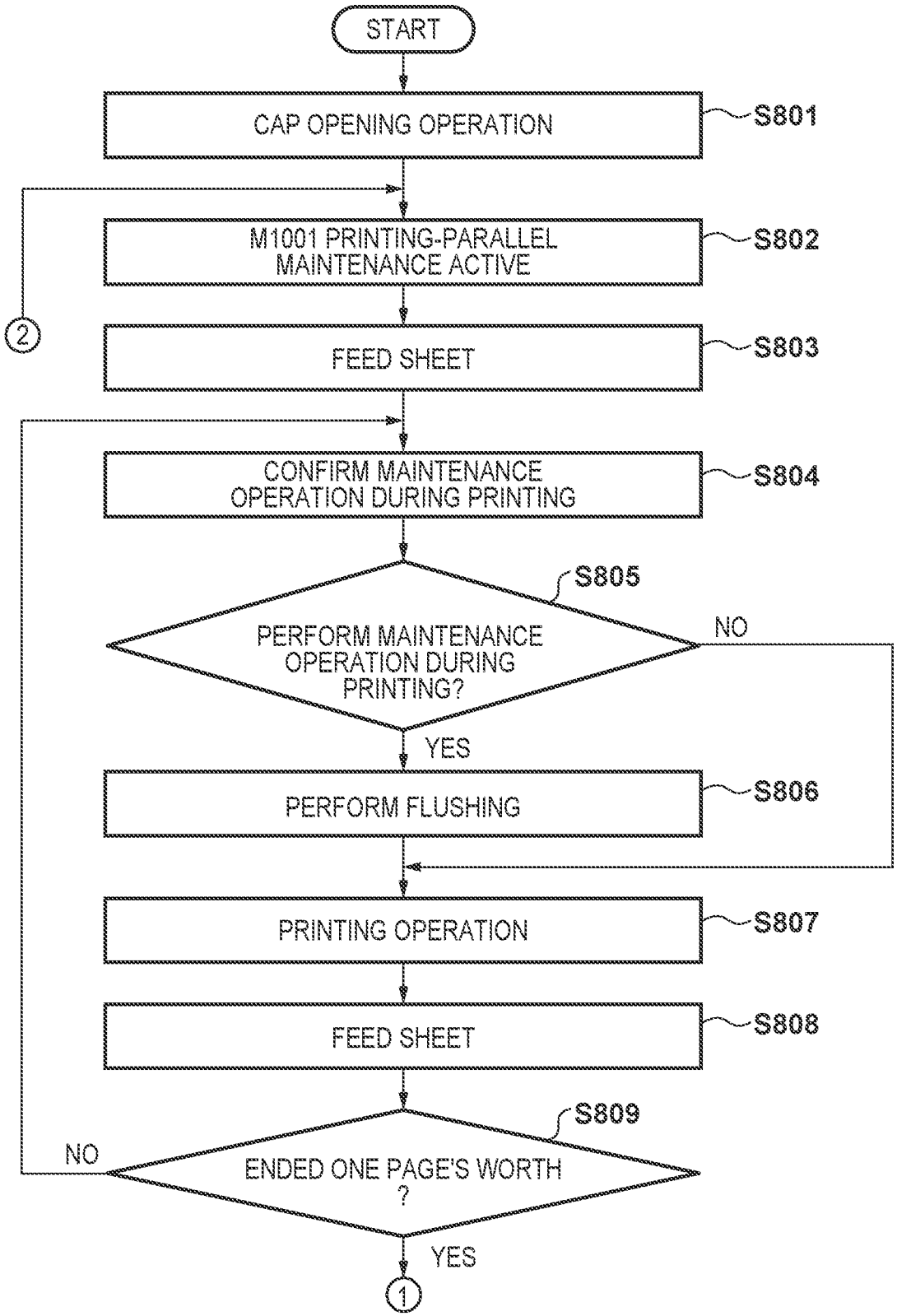
FIGS. 8A and 8B are flowcharts illustrating main task processing.
Figure 8B:
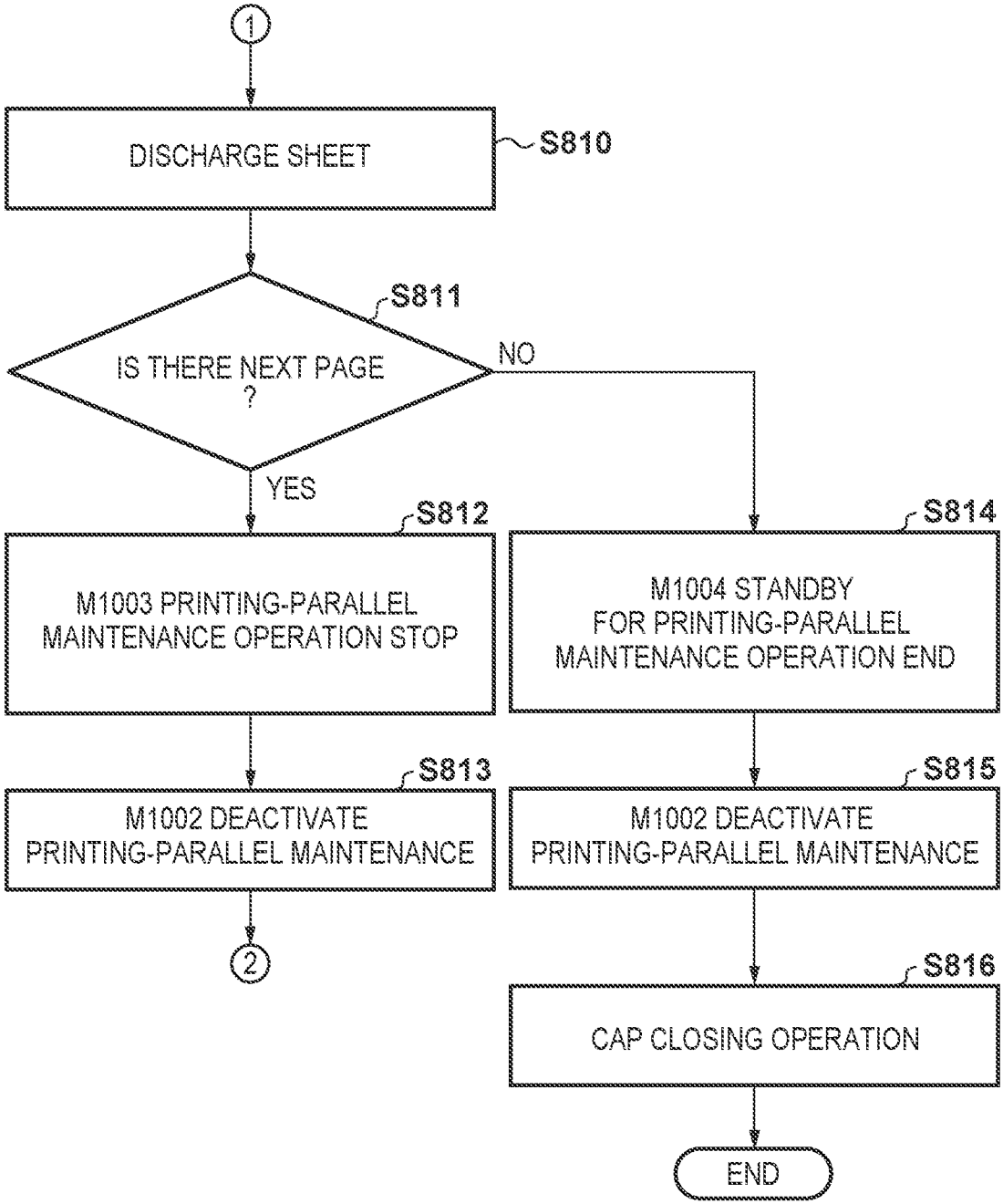

FIGS. 8A and 8B are flowcharts illustrating processing of the main task 600. The processing of the main task 600 will be described in detail with reference to the flowchart in FIGS. 8A and 8B. Printing of the second page will be described as an example below.

In step S801, the main task 600 performs a cap opening operation. For example, the CPU 120 instructs the printing head control unit 133 and the motor control unit 134 to perform the cap opening operation via the local bus 110 and the device I/O 125. When the motor 231 is driven under the control of the motor control unit 134, the cap 233 is controlled via the drive switching device 232, and the connection between the cap 233 and the printing head 212 is released.

In step S802, the main task 600 activates the printing-parallel maintenance operation by sending the message M1001 (parallel-printing maintenance active) to the sub task 601.

In step S803, the main task 600 performs sheet feeding in order to move the sheet 223 to a printing position. For example, the CPU 120 instructs the motor control unit 134 to perform the sheet feeding. The motor 221 is driven under the control of the motor control unit 134, and the position of the sheet 223 is controlled by driving the paper feed roller 222.

In step S804, the main task 600 confirms the maintenance operation during printing. For example, the CPU 120 determines a number of ink ejections for performing the flushing on the basis of an amount of time that has passed since the time ink was last ejected or the like. Note that the flushing is not performed when the number of ink ejections is determined to be 0.

In step S805, the main task 600 determines whether or not to perform the maintenance operation during printing. The sequence moves to step S806 when it is determined that the maintenance operation during printing is to be performed, and to step S807 when it is determined that the maintenance operation during printing is not to be performed.

In step S806, the main task 600 performs the flushing. For example, the CPU 120 instructs the motor control unit 134 and the printing head control unit 133 to perform flushing operations via the local bus 110 and the device I/O 125. In the flushing operations, the printing head 212 moves to the position P1 and ejects ink from the nozzles. The ejected ink is held in the cap 233. Then, on the basis of the amount of ink held in the cap 233, the CPU 120 updates the value of the parameter of the cap-retained ink counter 300 indicating the amount of ink. Steps S801 to S806 correspond to the start of printing of the first page in step S701 of FIG. 7.

In step S807, the main task 600 performs printing operations. For example, the CPU 120 transfers a pattern prestored in the ROM 121, a pattern loaded into the RAM 122 from the USB 130 or the NIC 131 via the I/F 123, or the like to the printing head control unit 133 via the local bus 110 and the device I/O 125. Driven by the motor 211, the printing head 212 prints by ejecting ink onto the sheet 223 while moving from the position P2 to P3, or from the position P3 to P2, illustrated in FIG. 2.

In step S808, the main task 600 feeds the sheet. For example, the CPU 120 instructs the motor control unit 134 to feed the sheet via the local bus 110 and the device I/O 125. When the motor 221 is driven under the control of the motor control unit 134, the paper feed roller 222 is driven and moves the sheet 223 in the transport direction by an amount required by the printing operations.

In step S809, the main task 600 determines whether or not one page's worth of printing has ended. If it is determined that one page's worth of printing has not ended, the processing is repeated from step S804. On the other hand, if in step S809 it is determined that one page's worth of printing has ended, the sequence moves to step S810. Steps S804 to S809 correspond to the printing in step S703 in FIG. 7.

When it is determined in step S809 that one page's worth of printing has ended, in step S810, the main task 600 discharges the sheet. For example, if the sheet 223 is cut paper, the CPU 120 instructs the motor control unit 134 to discharge the sheet via the local bus 110 and the device I/O 125. When the motor 221 is driven under the control of the motor control unit 134, the paper feed roller 222 is driven and the sheet 223 is discharged. If the sheet 223 is roll paper, processing corresponding to a roll paper configuration may be performed. For example, cutting processing using a cutter, rolling processing using a take-up device, or the like may be performed.

In step S811, the main task 600 determines whether or not there is a next page (a subsequent page). If, for example, the current page is the second page in two pages of printing, it is determined that there is no next page, and the sequence moves to step S814. On the other hand, if, for example, the current page is the first page in two pages of printing, it is determined that there is a next page, and the sequence moves to step S812.

In step S812, the main task 600 stops the printing-parallel maintenance operation by sending the message M1003 (printing-parallel maintenance operation stop) to the sub task 601. After sending the message M1003, the main task 600 stands by for the reply M1005 from the sub task 601, and once the reply M1005 is received, the sequence moves to step S813.

In step S813, the main task 600 deactivates the printing-parallel maintenance operation by sending the message M1002 (printing-parallel maintenance inactive) to the sub task 601. Steps S810 to S813 correspond to the end of printing of the first page in step S709 of FIG. 7.

In this manner, in the present embodiment, the sub task 601 is requested to stop the printing-parallel maintenance operation when it is determined that there is next page. Such a configuration makes it possible to prioritize the printing of the next page without waiting for the printing-parallel maintenance operation to be completed, which in turn makes it possible to prevent a situation where the progress of printing a plurality of pages is delayed due to the printing-parallel maintenance operation.

The steps up to step S813 are processing for the first page, after which the sequence returns to step S802, where the processing for the second page is started. The processing for the second page is the same as that described for the first page, up to step S811. Steps S802 to S806 correspond to the start of printing of the second page in step S710 of FIG. 7.

In step S811, the main task 600 determines whether or not there is a next page. Here, because the current page is the second page in two pages of printing, it is determined that there is no next page, and the sequence moves to step S814. In step S814, the main task 600 stands by for the end of the printing-parallel maintenance operation by the sub task 601 by sending the message M1004 (printing-parallel maintenance operation end standby) to the sub task 601. After sending the message M1004, the main task 600 stands by for the reply M1005 from the sub task 601, and once the reply M1005 is received, the sequence moves to step S815.

In step S815, the main task 600 deactivates the printing-parallel maintenance operation by sending the message M1002 (printing-parallel maintenance inactive) to the sub task 601.

In step S816, the main task 600 performs a cap closing operation. For example, the CPU 120 instructs the printing head control unit 133 and the motor control unit 134 to perform the cap closing operation via the local bus 110 and the device I/O 125. When the motor 211 is driven under the control of the printing head control unit 133, the printing head 212 moves to the position P1 in FIG. 2. When the motor 231 is driven under the control of the motor control unit 134, the cap 233 is controlled via the drive switching device 232, and the printing head 212 is protected by the cap 233. The processing of FIGS. 8A and 8B end after step S816. Steps S810, S811, and S814 to S816 correspond to the end of printing of the second page in step S718 of FIG. 7.

Figure 9A:
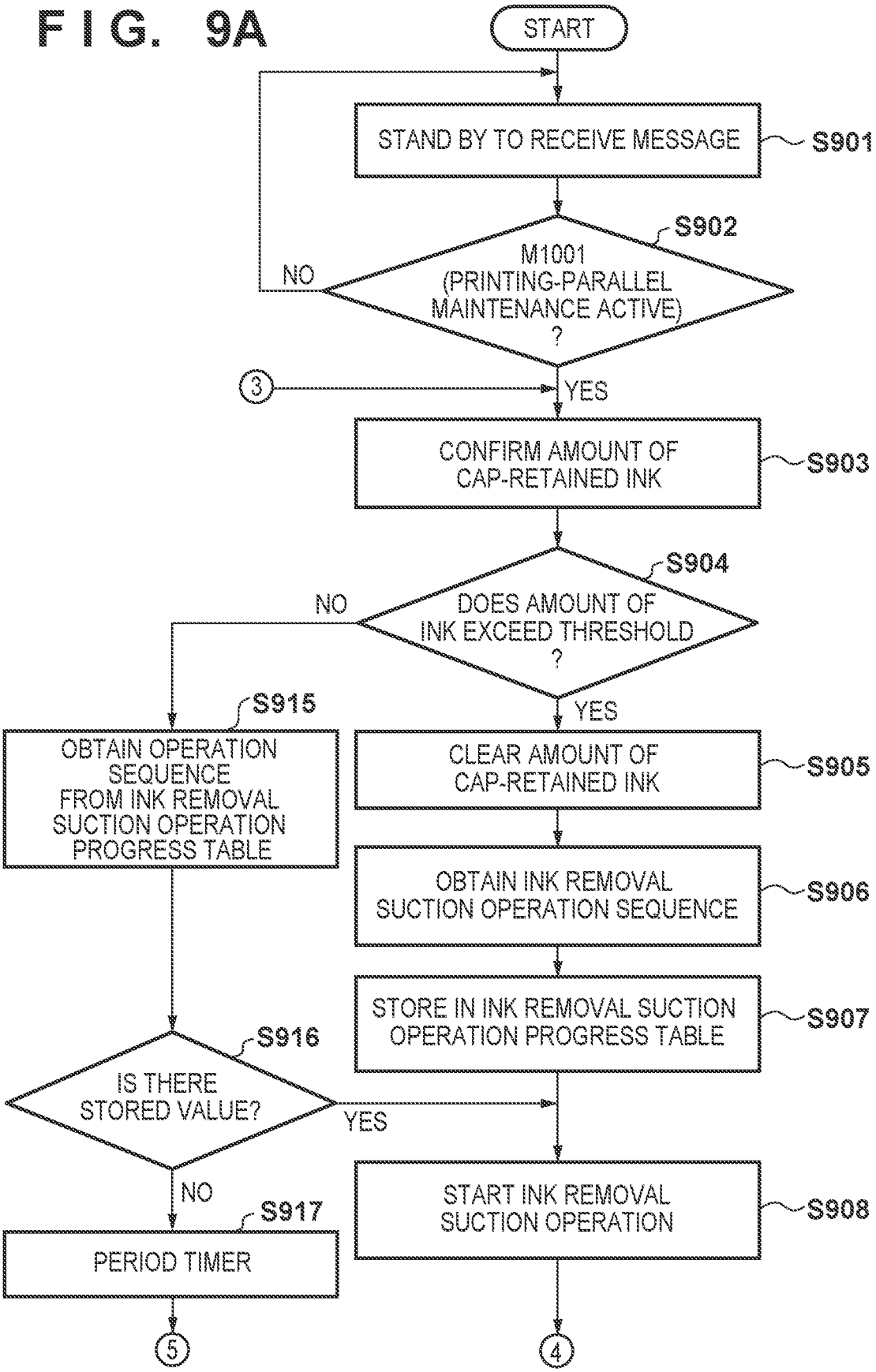
FIGS. 9A and 9B are flowcharts illustrating sub task processing.
Figure 9B:
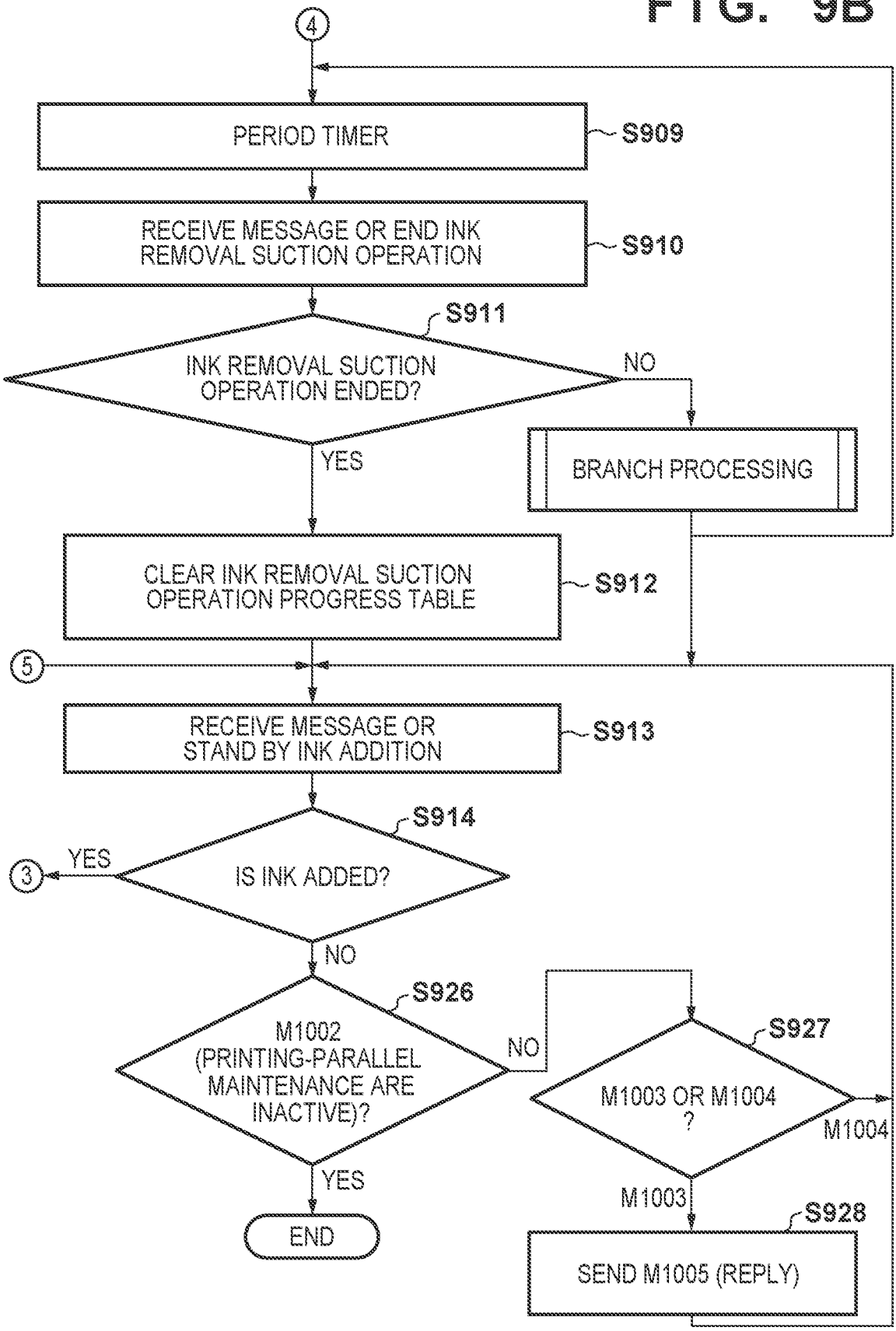
Figure 10:
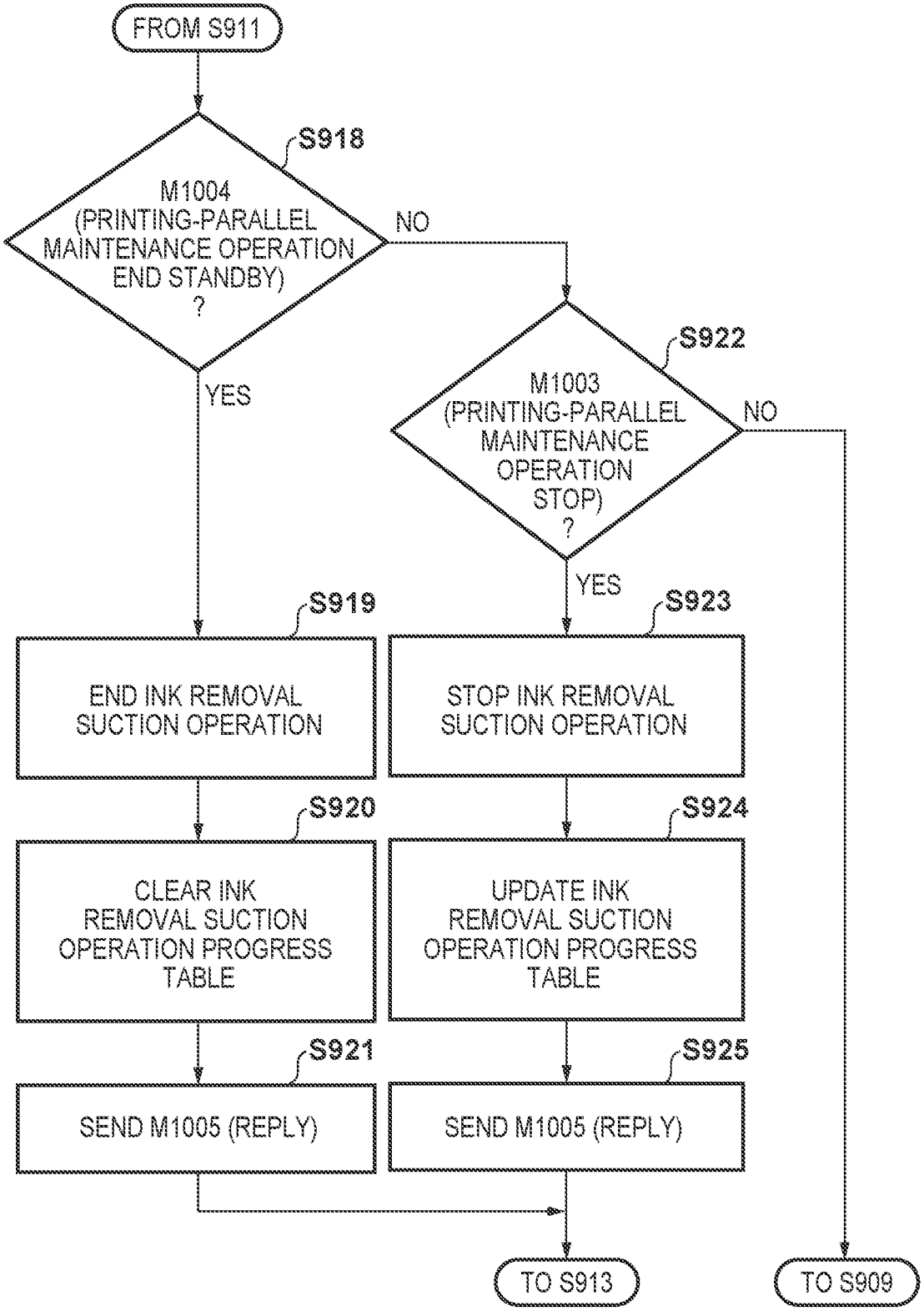
FIG. 10 is a flowchart illustrating sub task processing.

FIGS. 9A, 9B, and 10 are flowcharts illustrating processing of the sub task 601. FIGS. 9A and 9B illustrate the overall processing of the sub task 601, and FIG. 10 illustrates branch processing of the overall processing of the sub task 601. The processing of the sub task 601 will be described in detail with reference to the flowcharts in FIGS. 9 and 10. Like the descriptions of the main task 600 given with reference to FIGS. 8A and 8B, printing of the second page will be described as an example. Here, the sub task 601 is launched and ended each time one page is printed.

Processing for the first page will be described first.

The sub task 601 is launched when the printing is started. In step S901, the sub task 601 stands by to receive a message from the main task 600. In step S902, the sub task 601 determines whether or not the message received from the main task 600 is the message M1001 (parallel-printing maintenance active). The sequence moves to step S903 when it is determined that the received message is the message M1001, whereas the processing is repeated from step S901 when it is determined that the message is not the message M1001.

In step S903, the sub task 601 confirms the amount of ink in the cap 233. For example, the CPU 120 obtains the value of the parameter of the cap-retained ink counter 300 indicating the amount of ink.

In step S904, the sub task 601 determines whether or not the value of the parameter of the cap-retained ink counter 300, indicating the amount of ink, exceeds a predetermined threshold. The sequence moves to step S905 if it is determined that the threshold is exceeded. On the other hand, the sequence moves to step S915 if it is determined that the threshold is not exceeded. For example, the sequence moves to step S905 when the value of the parameter of the cap-retained ink counter 300, indicating the amount of ink, has exceeded the threshold due to the maintenance operation during printing performed in step S703 in FIG. 7.

If in step S904 it is determined that the threshold is not exceeded, in step S915, the sub task 601 refers to each of the parameters in the ink removal suction operation progress table 500. Then, in step S916, the sub task 601 determines whether or not there is a value stored in each of the parameters in the ink removal suction operation progress table 500. The sequence moves to step S908 if it is determined that there is a value stored in each of the parameters of the ink removal suction operation progress table 500. On the other hand, the sequence moves to step S917 if it is determined that there is no value stored. The processing of steps S915 and S916 will be described with reference to the processing for the second page. In step S917, the sub task 601 delays a period timer by approximately 10 milliseconds, after which the sequence moves to step S913.

If it is determined in step S904 that the threshold is exceeded, in step S905, the sub task 601 clears the value of the parameter of the cap-retained ink counter 300 indicating the amount of ink. For example, the CPU 120 sets the value of the parameter of the cap-retained ink counter 300, indicating the amount of ink, to an initial value (e.g., zero).

In step S906, the sub task 601 obtains values of parameters of an ink removal suction operation sequence. For example, the CPU 120 obtains the values of drive speed 401 and total drive amount 402 from the ink removal suction operation sequence table 400.

In step S907, the sub task 601 stores the values of the parameters of the ink removal suction operation sequence, obtained in step S906, in the ink removal suction operation progress table 500. For example, through the processing of step S907, the values of the parameters in the ink removal suction operation progress table 500 are set as indicated in FIG. 5B, and the values of the parameters decrease as indicated in FIG. 5C as the ink removal suction operations performed in a later stage progress.

In step S908, the sub task 601 starts the ink removal suction operations. For example, the CPU 120 issues a drive command to the motor control unit 134 via the local bus 110 and the device I/O 125 in accordance with the parameters stored in the ink removal suction operation progress table 500. Then, by driving the motor 231 under the control of the motor control unit 134 and driving the pump 234 via the drive switching device 232, the ink held in the cap 233 is moved to the waste ink reservoir 235 via the ink flow channel 236. In step S909, the sub task 601 executes the period timer. Then, delay of approximately 10 milliseconds is applied by the CPU 120 or a real-time clock (not shown).

In step S910, the sub task 601 confirms that either of the following conditions is satisfied: that a message sent from the main task 600 has been received; or that the ink removal suction operations started in step S908 have ended. The sequence moves to step S911 if it is confirmed that either of the conditions is satisfied. In step S911, the sub task 601 determines whether or not the ink removal suction operations have ended.

Here, if the printing of the first page is longer than the ink removal suction operations, the ink removal suction operations will end before the message from the main task 600 is received. Therefore, in such a case, the sequence moves to step S912. On the other hand, if the printing of the first page is shorter than the ink removal suction operations, the message from the main task 600 will be received before the end of the ink removal suction operations. Therefore, in such a case, the sequence moves to the branch processing illustrated in FIG. 10.

A case where the printing of the first page is longer than the ink removal suction operations will be described.

In step S912, the sub task 601 clears the value of each of the parameters in the ink removal suction operation progress table 500. For example, the CPU 120 sets the value of each of the parameters in the ink removal suction operation progress table 500 to an initial value (e.g., zero).

In step S913, the sub task 601 confirms that either of the following conditions is satisfied: that a message sent from the main task 600 has been received; or that the value of the parameter of the cap-retained ink counter 300, indicating the amount of ink, has been added. The sequence moves to step S914 if it is confirmed that either of the conditions is satisfied. In step S914, the sub task 601 determines whether the confirmed condition is that the value of the parameter of the cap-retained ink counter 300, indicating the amount of ink, has been added.

Here, if it is determined that the confirmed condition is that the value of the parameter of the cap-retained ink counter 300, indicating the amount of ink, has been added, the processing is repeated from step S903. If the amount of ink resulting from the adding exceeds a threshold, the processing is repeated from step S905. On the other hand, if the amount of ink resulting from adding does not exceed the threshold, the value of each of the parameters in the ink removal suction operation progress table 500 is already clear, and thus the sequence moves to step S913 via steps S916 and S917. In other words, when the printing of the first page in two pages of printing is longer than the ink removal suction operations, if the value of the perimeter indicating the amount of ink is added as flushing is executed, the ink removal suction operations will be performed if the value exceeds the threshold.

On the other hand, if it is determined that the confirmed condition is that the message sent from the main task 600 has been received, the sequence moves to step S926. In step S926, the sub task 601 determines whether or not the message received from the main task 600 is the message M1002 (printing-parallel maintenance inactive).

As per the descriptions of the processing of the main task 600 given with reference to FIGS. 8A and 8B, in the processing performed when the printing of the first page in two pages of printing ends, the message M1003 (printing-parallel maintenance operation stop) and the message M1002 (printing-parallel maintenance inactive) are received from the main task 600 in that order after the end of the ink removal suction operations. As such, the message M1003 is received first, and the sequence therefore moves to step S927.

In step S927, the sub task 601 determines whether the message received from the main task 600 is the message M1003 (printing-parallel maintenance operation stop) or the message M1004 (printing-parallel maintenance operation end standby). Here, the message received from the main task 600 is the message M1003, and the sequence therefore moves to step S928.

In step S928, the sub task 601 sends the reply M1005 to the main task 600, after which the processing is repeated from step S913. In step S913, the sub task 601 receives the message M1002 (printing-parallel maintenance inactive) from the main task 600, and thus after step S914, it is determined that the message M1002 (printing-parallel maintenance inactive) has been received in step S926. The processing of the sub task 601 then ends, and the printing of the first page ends as well.

A case where the printing of the first page is shorter than the ink removal suction operations will be described next.

As mentioned above, if the printing of the first page is shorter than the ink removal suction operations, the message from the main task 600 will be received before the end of the ink removal suction operations. As per the main task 600 described with reference to FIGS. 8A and 8B, in the processing performed when the printing of the first page in two pages of printing ends, the message M1003 (printing-parallel maintenance operation stop) is received before the ink removal suction operations end.

When the printing of the first page is shorter than the ink removal suction operations, the branch processing of FIG. 10 is performed. In step S918 of FIG. 10, the sub task 601 determines whether or not the message received from the main task 600 is the message M1004 (printing-parallel maintenance operation end standby). Here, because the message M1003 has been received, it is determined that the message is not the message M1004, and the sequence moves to step S922.

In step S922, the sub task 601 determines whether or not the message received from the main task 600 is the message M1003 (printing-parallel maintenance operation stop). Here, the message M1003 has been received, and the sequence therefore moves to step S923.

In step S923, the sub task 601 stops the ink removal suction operations. For example, the CPU 120 issues a drive command to the motor control unit 134 via the local bus 110 and the device I/O 125. The motor 231 is then stopped under the control of the motor control unit 134.

In step S924, the sub task 601 updates the value of each of the parameters in the ink removal suction operation progress table 500. For example, the CPU 120 obtains a completed drive amount from the motor 231 using an encoder or the like (not shown), and updates the value of each of the parameters in the ink removal suction operation progress table 500 on the basis of the completed drive amount which has been obtained. The update is performed by, for example, subtracting the completed drive amount from the value of drive amount 502. In step S925, the sub task 601 sends the reply M1005 to the main task 600, after which the sequence moves to step S913.

Then, in step S913, the sub task 601 receives the message M1002 (printing-parallel maintenance inactive) from the main task 600, and thus after step S914, it is determined that the message M1002 has been received in step S926. The processing of the sub task 601 then ends, and the printing of the first page ends as well.

As mentioned above, when the printing of the first page is shorter than the ink removal suction operations, the sequence moves from step S911 to step S913 through the branch processing in FIG. 10. Accordingly, each of the parameters in the ink removal suction operation progress table 500 is not cleared in step S912, and the values are updated in step S924. In the present embodiment, such a configuration makes it possible to store the remainder of ink removal suction operations suspended due to the printing of the first page being shorter than the ink removal suction operations. The remainder of the ink removal suction operations which is stored is then performed in parallel with the processing for the second page.

Processing for the second page will be described next.

When printing starts, the sub task 601 is launched in the same manner as with the first page. Steps S901 to S904 are the same as described for the first page. Additionally, if it is determined in step S904 that the value of the parameter of the cap-retained ink counter 300, indicating the amount of ink, exceeds the predetermined threshold, the processing up to step S911 is the same as described for the first page.

If it is determined in step S904 that the value of the parameter of the cap-retained ink counter 300, indicating the amount of ink, does not exceed the predetermined threshold, the sequence moves to step S915. In step S915, the sub task 601 refers to each of the parameters in the ink removal suction operation progress table 500, and in step S916, determines whether or not there is a value stored in each of the parameters of the ink removal suction operation progress table 500. Here, if the value stored in each of the parameters of the ink removal suction operation progress table 500 is a value aside from the initial value, it is determined that a value is stored. The sequence moves to step S917 if it is determined that there is no value stored. The processing after step S917 is the same as described for the first page. On the other hand, the sequence moves to step S908 if it is determined that there is a value stored in each of the parameters of the ink removal suction operation progress table 500.

A case where it is determined that there is a value stored in each of the parameters of the ink removal suction operation progress table 500 will be described here.

In step S908, the sub task 601 starts the ink removal suction operations using the values of drive speed 501 and drive amount 502 which are stored. The processing up to step S911 is the same as described for the first page. In step S911, the sub task 601 determines whether or not the ink removal suction operations have ended. If the printing of the second page is longer than the ink removal suction operations, the ink removal suction operations will end before the message from the main task 600 is received, and the sequence therefore moves to step S912. On the other hand, if the printing of the second page in the printing of two pages is shorter than the ink removal suction operations, the message M1004 (printing-parallel maintenance operation end standby) is received from the main task 600, as described for the main task 600 with reference to FIGS. 8A and 8B. Therefore, in this case, the sequence moves from step S918 to S919 in FIG. 10.

In this manner, in the present embodiment, the remainder of ink removal suction operations suspended due to the printing of the first page being shorter than the ink removal suction operations can be performed in parallel with the processing for the second page, which is a subsequent page.

A case where the printing of the second page is longer than the ink removal suction operations will be described.

As described with reference to FIGS. 8A and 8B, in the processing performed when the printing of the second page in two pages of printing ends, the message M1004 (printing-parallel maintenance operation end standby) and the message M1002 (printing-parallel maintenance inactive) are received from the main task 600 in that order after the end of the ink removal suction operations.

In step S912, the sub task 601 clears the value of each of the parameters in the ink removal suction operation progress table 500. For example, the CPU 120 sets the value of each of the parameters in the ink removal suction operation progress table 500 to an initial value (e.g., zero).

In step S913, the sub task 601 confirms that either of the following conditions is satisfied: that a message sent from the main task 600 has been received; or that the value of the parameter of the cap-retained ink counter 300, indicating the amount of ink, has been added. The sequence moves to step S914 if it is confirmed that either of the conditions is satisfied. In step S914, the sub task 601 determines whether the confirmed condition is that the value of the parameter of the cap-retained ink counter 300, indicating the amount of ink, has been added.

Here, if it is determined that the confirmed condition is that the value of the parameter of the cap-retained ink counter 300, indicating the amount of ink, has been added, the processing is repeated from step S903. On the other hand, if it is determined that the confirmed condition is that the message sent from the main task 600 has been received, the sequence moves to step S926.

In step S926, the sub task 601 determines whether or not the message received from the main task 600 is the message M1002 (printing-parallel maintenance inactive).

As described for the processing of the main task 600 with reference to FIGS. 8A and 8B, in the processing performed when the printing of the second page in two pages of printing ends, the message M1004 (printing-parallel maintenance operation end standby) and the message M1002 (printing-parallel maintenance inactive) are received from the main task 600 in that order after the end of the ink removal suction operations. As such, the message M1004 is received first, and the sequence therefore moves to step S927.

In step S927, the sub task 601 determines whether the message received from the main task 600 is the message M1003 (printing-parallel maintenance operation stop) or the message M1004 (printing-parallel maintenance operation end standby). Here, the message received from the main task 600 is the message M1004, and the sequence therefore moves to step S913.

In step S913, the sub task 601 receives the message M1002 (printing-parallel maintenance inactive) from the main task 600, and thus after step S914, it is determined that the message M1002 has been received in step S926. The processing of the sub task 601 then ends, and the printing of the second page ends as well.

A case where the printing of the second page is shorter than the ink removal suction operations will be described next.

When the printing of the second page is shorter than the ink removal suction operations, the branch processing of FIG. 10 is performed from step S911. In step S918 of FIG. 10, the sub task 601 determines whether or not the message received from the main task 600 is the message M1004 (printing-parallel maintenance operation end standby). In the processing performed when the printing of the second page in two pages of printing ends, the message M1004 (printing-parallel maintenance operation end standby) is received before the ink removal suction operations end, and the sequence therefore moves to step S919.

In step S919, the sub task 601 completes the ink removal suction operations. In step S920, the sub task 601 clears the value of each of the parameters in the ink removal suction operation progress table 500. For example, the CPU 120 sets the value of each of the parameters in the ink removal suction operation progress table 500 to an initial value (e.g., zero). In step S921, the sub task 601 sends the reply M1005 to the main task 600, after which the sequence moves to step S913.

Then, in step S913, the sub task 601 receives the message M1002 (printing-parallel maintenance inactive) from the main task 600, and thus after step S914, it is determined that the message M1002 has been received in step S926. The processing of the sub task 601 then ends, and the printing of the second page ends as well.

Steps S908 to S912 in FIGS. 9A and 9B correspond to the printing-parallel maintenance operation of steps S704 and S713 in FIG. 7. Likewise, steps S923 and S924 correspond to the suspension operation of step S706 in FIG. 7, and steps S919 and S920 correspond to the completion of the printing-parallel maintenance operation in step S715 in FIG. 7.

As described above, according to the present embodiment, if the printing of one page is shorter than the ink removal suction operations and there is a subsequent page when the printing of the one page ends (e.g., a second page), the printing-parallel maintenance operation is suspended. The remainder of the printing-parallel maintenance operation resulting from the suspension is performed in parallel with the printing of the subsequent page. Such a configuration makes it possible to prevent a situation where the overall progress of print processing is delayed due to the printing-parallel maintenance operation.

Second Embodiment

Figure 12A:
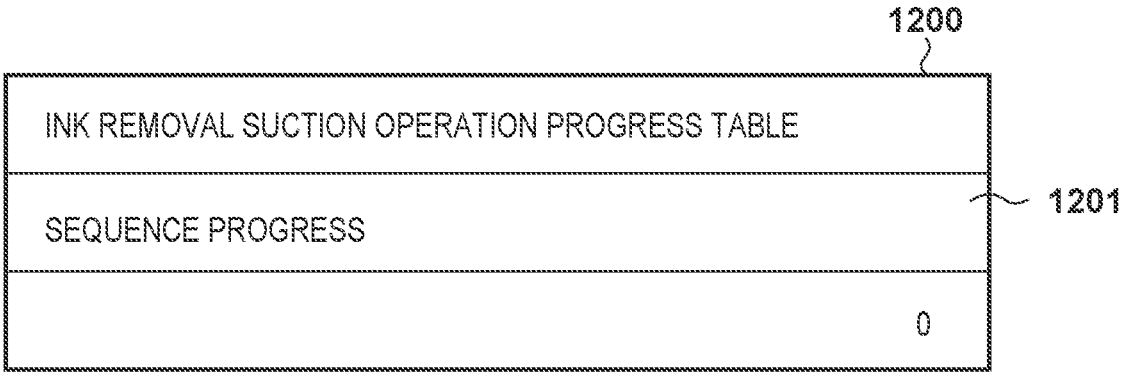
FIGS. 12A and 12B are diagrams illustrating an ink removal suction operation progress table.
Figure 12B:
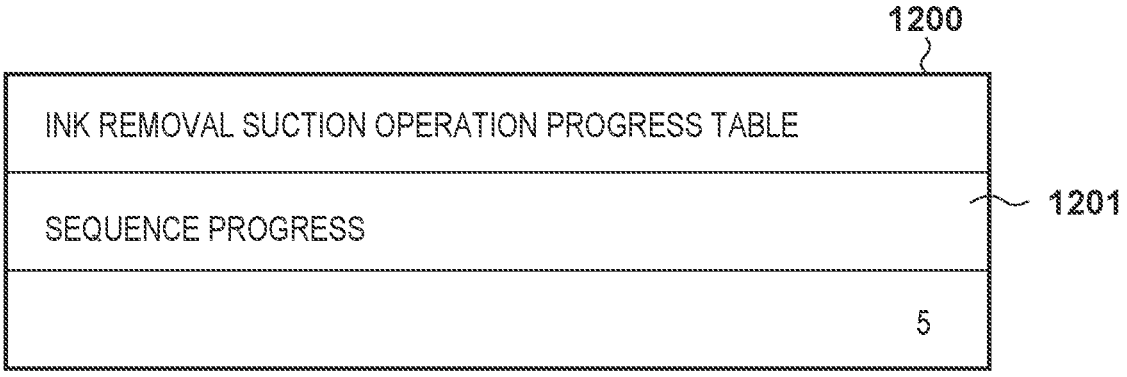

A second embodiment will be described next, focusing on differences from the first embodiment. FIG. 11 is a diagram illustrating an example of an ink removal suction operation sequence table 1100 according to the present embodiment. Additionally, FIGS. 12A and 12B are diagrams illustrating an example of an ink removal suction operation progress table 1200 according to the present embodiment. The ink removal suction operation sequence table 1100 and the ink removal suction operation progress table 1200 are stored, for example, in the ROM 121, the RAM 122, or the like of the control system 100.

In the present embodiment, the ink removal suction operation sequence table 1100 and the ink removal suction operation progress table 1200 do not have the same data structure. The ink removal suction operation sequence table 1100 has a data structure in which the maintenance operations are broken down into a plurality of units of driving (step operations), and has parameters of step 1101, drive speed 1102, and drive amount 1103. In the ink removal suction operation progress table 1200, a step number which, among step numbers stored in the step 1101 of the ink removal suction operation sequence table 1100, is the lowest step number of unexecuted steps, is stored in sequence progress 1201.

Figure 13A:
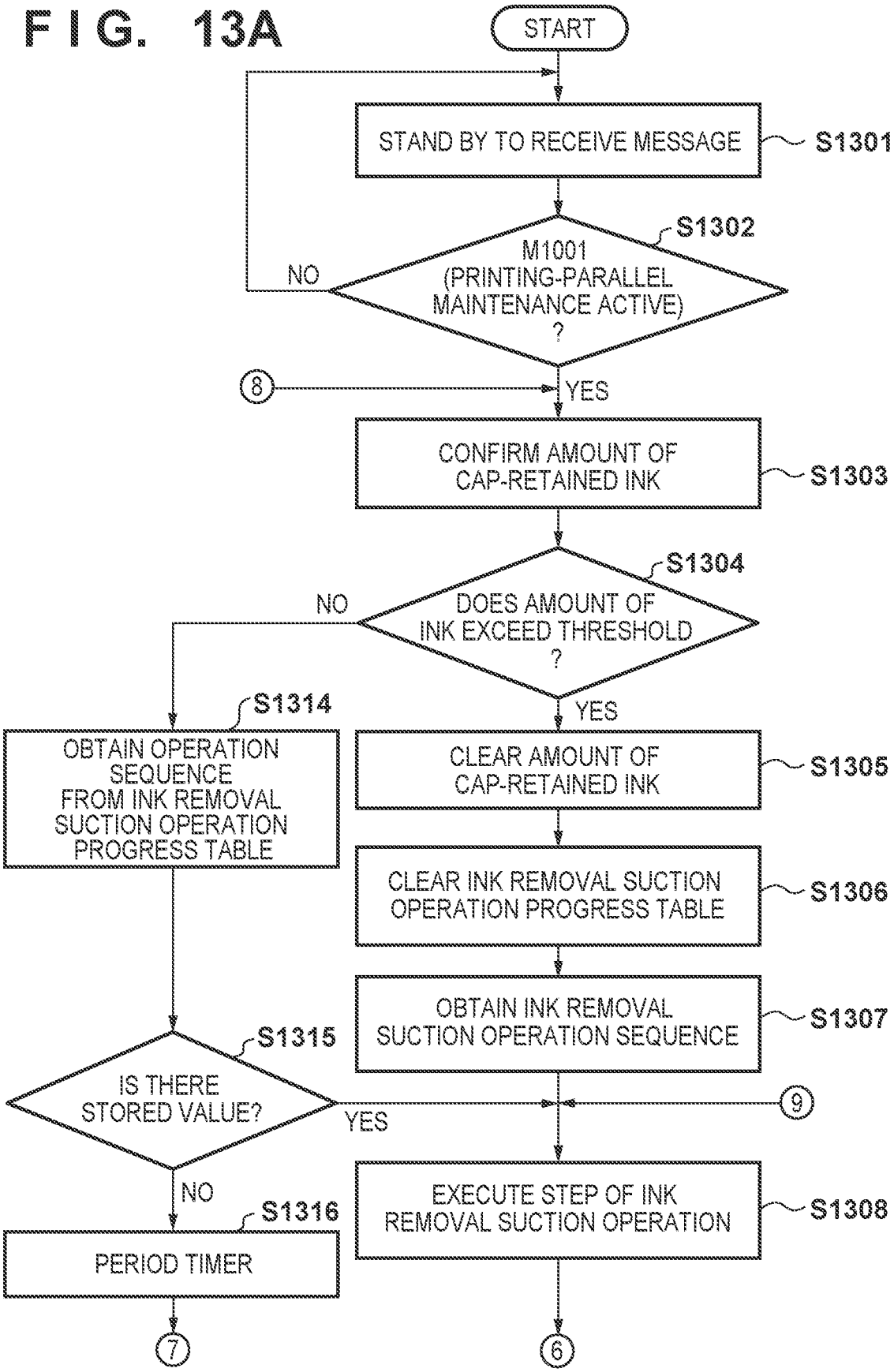
FIGS. 13A and 13B are flowcharts illustrating sub task processing.
Figure 13B:
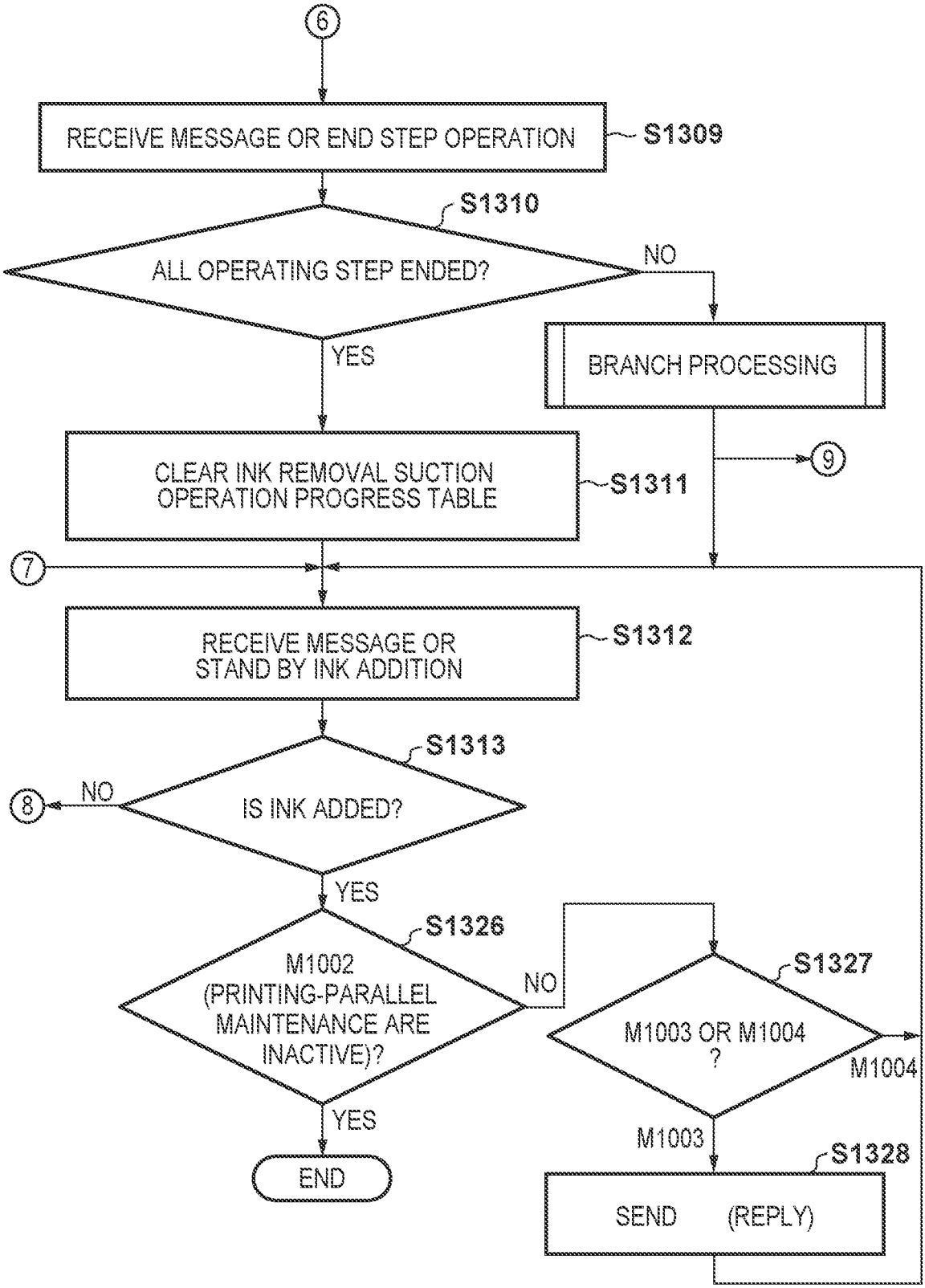
Figure 14:
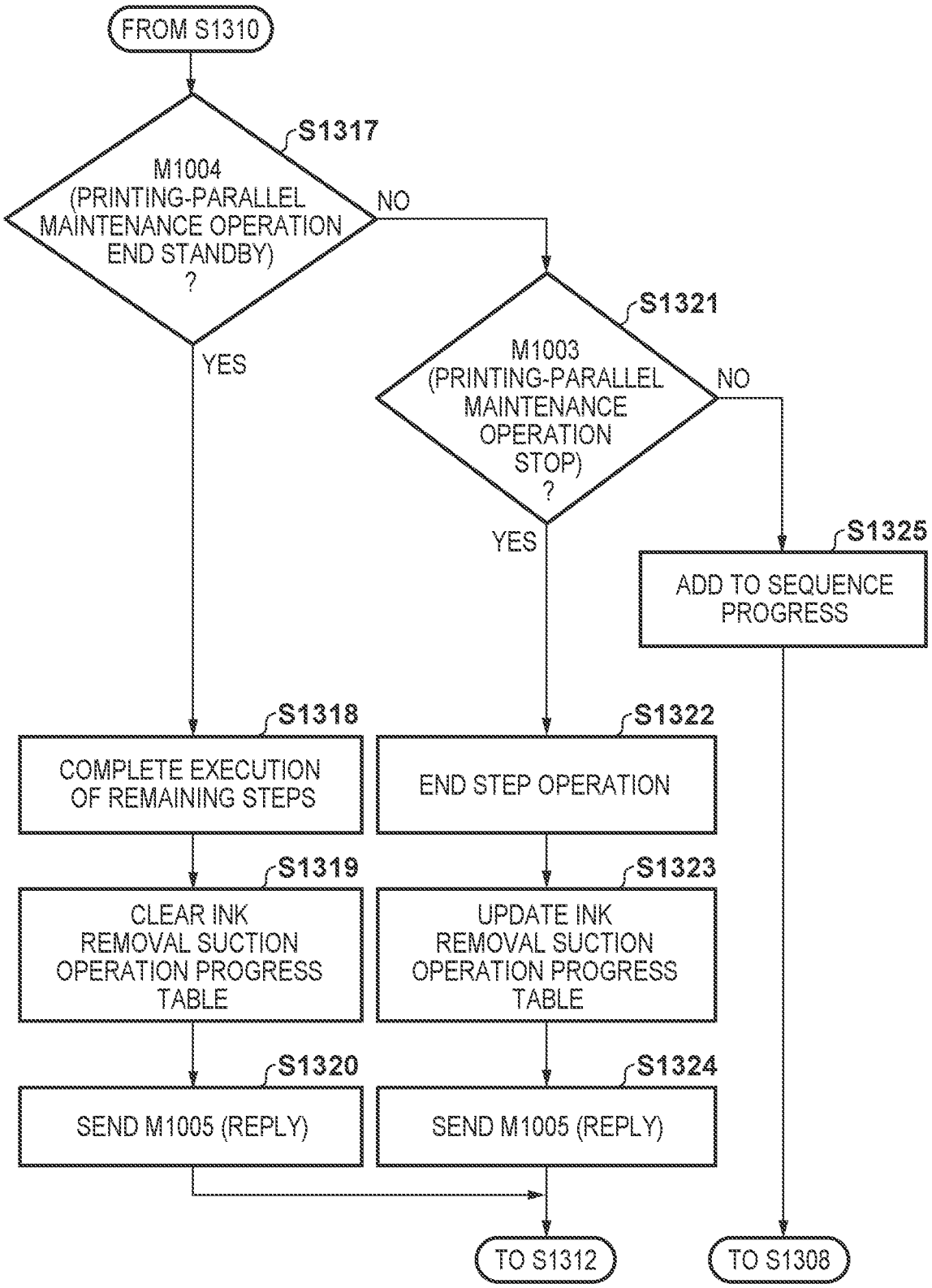
FIG. 14 is a flowchart illustrating sub task processing.

FIGS. 13A, 13B, and 14 are flowcharts illustrating processing of the sub task 601. FIGS. 13A and 13B illustrate the overall processing of the sub task 601, and FIG. 14 illustrates branch processing of the overall processing of the sub task 601. The processing of the sub task 601 will be described in detail with reference to the flowcharts in FIGS. 13 and 14. Printing of the second page will be described as an example below. Here, the sub task 601 is launched and ended each time one page is printed.

Processing for the first page will be described first.

The sub task 601 is launched when the printing is started. In step S1301, the sub task 601 stands by to receive a message from the main task 600. In step S1302, the sub task 601 determines whether or not the message received from the main task 600 is the message M1001 (parallel-printing maintenance active). The sequence moves to step S1303 if it is determined that the received message is the message M1001, whereas the processing is repeated from step S1301 if it is determined that the message is not the message M1001.

In step S1303, the sub task 601 confirms the amount of ink in the cap 233. For example, the CPU 120 obtains the value of the parameter of the cap-retained ink counter 300 indicating the amount of ink.

In step S1304, the sub task 601 determines whether or not the value of the parameter of the cap-retained ink counter 300, indicating the amount of ink, exceeds a predetermined threshold. The sequence moves to step S1305 if it is determined that the threshold is exceeded. On the other hand, the sequence moves to step S1314 if it is determined that the threshold is not exceeded. For example, the sequence moves to step S1305 when the value of the parameter of the cap-retained ink counter 300, indicating the amount of ink, has exceeded the threshold due to the maintenance operation during printing performed in step S703 in FIG. 7.

If in step S1304 it is determined that the threshold is not exceeded, in step S1314, the sub task 601 refers to each of the parameters in the ink removal suction operation progress table 500. Then, in step S1315, the sub task 601 determines whether or not there is a value stored in each of the parameters in the ink removal suction operation progress table 500. The sequence moves to step S1308 if it is determined that there is a value stored in each of the parameters of the ink removal suction operation progress table 500. On the other hand, the sequence moves to step S1316 if it is determined that there is no value stored. The processing of steps S1314 and S1315 will be described with reference to the processing for the second page. In step S1316, the sub task 601 delays a period timer by approximately 10 milliseconds, after which the sequence moves to step S1312.

If it is determined in step S1304 that the threshold is exceeded, in step S1305, the sub task 601 clears the value of the parameter of the cap-retained ink counter 300 indicating the amount of ink. For example, the CPU 120 sets the value of the parameter of the cap-retained ink counter 300, indicating the amount of ink, to an initial value (e.g., zero).

In step S1306, the sub task 601 clears the values of the parameters in the ink removal suction operation progress table 1200. For example, the CPU 120 initializes (e.g., sets to zero) the value of sequence progress 1201 in the ink removal suction operation progress table 1200. The cleared value corresponds to the lowest step number in step 1101 of the ink removal suction operation sequence table 1100. FIG. 12A is a diagram illustrating an example of a state in which the value of the parameter in the ink removal suction operation progress table 1200 has been initialized.

In step S1307, the sub task 601 obtains parameters of an ink removal suction operation sequence. For example, the CPU 120 obtains the values of step 1101, drive speed 1102, and drive amount 1103 from the ink removal suction operation sequence table 1100.

In step S1308, the sub task 601 executes a step of the ink removal suction operations. For example, the CPU 120 obtains the step number stored in sequence progress 1201 of the ink removal suction operation progress table 1200. Then, of the step numbers in step 1101 of the ink removal suction operation sequence table 1100, drive speed 1102 and drive amount 1103 corresponding to the obtained step number are obtained. The CPU 120 then issues a drive command to the motor control unit 134 via the local bus 110 and the device I/O 125. By driving the motor 231 under the control of the motor control unit 134 and driving the pump 234 via the drive switching device 232, the ink held in the cap 233 is moved to the waste ink reservoir 235 via the ink flow channel 236.

In step S1309, the sub task 601 confirms that either of the following conditions is satisfied: that a message sent from the main task 600 has been received; or that the execution of the step of the ink removal suction operations in step S1308 has ended. The sequence moves to step S1310 if it is confirmed that either of the conditions is satisfied. In step S1310, the sub task 601 determines whether or not all of the steps of the ink removal suction operations have ended.

For example, if all the steps of the ink removal suction operations have not ended, and no message has been received from the main task 600, the sequence moves to the branch processing in FIG. 14. In step S1317 of FIG. 14, the sub task 601 determines whether or not the message sent from the main task 600 is the message M1004 (printing-parallel maintenance operation end standby). Here, because no message from the main task 600 is received, it is determined that the message is not the message M1004, and the sequence moves to step S1321. In step S1321, the sub task 601 determines whether or not the message sent from the main task 600 is the message M1003 (printing-parallel maintenance operation stop). Here, because no message from the main task 600 is received, it is determined that the message is not the message M1003, and the sequence moves to step S1325. In step S1325, the sub task 601 adds 1 to the value of sequence progress 1201 in the ink removal suction operation progress table 1200. The sequence then returns to step S1308, and the ink removal suction operations corresponding to the next step number are executed.

Here, if the printing of the first page is longer than the ink removal suction operations, all of the steps of the ink removal suction operations will end before the message from the main task 600 is received. Therefore, in such a case, the sequence moves from step S1310 to step S1311. On the other hand, if the printing of the first page is shorter than the ink removal suction operations, the message from the main task 600 will be received before the end of all of the steps of the ink removal suction operations. Therefore, in such a case, the sequence moves from step S1310 to the branch processing illustrated in FIG. 14.

A case where the printing of the first page is longer than the ink removal suction operations will be described.

In step S1311, the sub task 601 clears the values of the parameters in the ink removal suction operation progress table 1200. For example, the CPU 120 sets the value of sequence progress 1201 in the ink removal suction operation progress table 1200 to the initial value (e.g., zero).

In step S1312, the sub task 601 confirms that either of the following conditions is satisfied: that a message sent from the main task 600 has been received; or that the value of the parameter of the cap-retained ink counter 300, indicating the amount of ink, has been added. The sequence moves to step S1313 if it is confirmed that either of the conditions is satisfied. In step S1313, the sub task 601 determines whether the confirmed condition is that the value of the parameter of the cap-retained ink counter 300, indicating the amount of ink, has been added.

Here, if it is determined that the confirmed condition is that the value of the parameter of the cap-retained ink counter 300, indicating the amount of ink, has been added, the processing is repeated from step S1303. On the other hand, if it is determined that the confirmed condition is that the message sent from the main task 600 has been received, the sequence moves to step S1326.

In step S1326, the sub task 601 determines whether or not the message received from the main task 600 is the message M1002 (printing-parallel maintenance inactive).

As per the descriptions of the processing of the main task 600 given with reference to FIGS. 8A and 8B, in the processing performed when the printing of the first page in two pages of printing ends, the message M1003 (printing-parallel maintenance operation stop) and the message M1002 (printing-parallel maintenance inactive) are received from the main task 600 in that order after the end of (all of the steps of) the ink removal suction operations. As such, the message M1003 is received first, and the sequence therefore moves to step S1327.

In step S1327, the sub task 601 determines whether the message received from the main task 600 is the message M1003 (printing-parallel maintenance operation stop) or the message M1004 (printing-parallel maintenance operation end standby). Here, the message received from the main task 600 is the message M1003, and the sequence therefore moves to step S1328.

In step S1328, the sub task 601 sends the reply M1005 to the main task 600, after which the processing is repeated from step S1312. In step S1312, the sub task 601 receives the message M1002 (printing-parallel maintenance inactive) from the main task 600. Accordingly, after step S1313, it is determined in step S1326 that the message M1002 (printing-parallel maintenance inactive) has been received. The processing of the sub task 601 then ends, and the printing of the first page ends as well.

A case where the printing of the first page is shorter than the ink removal suction operations will be described next.

As mentioned above, if the printing of one page is shorter than the ink removal suction operations, the message from the main task 600 will be received before the end of all of the steps of the ink removal suction operations. As per the main task 600 described with reference to FIGS. 8A and 8B, in the processing performed when the printing of the first page in two pages of printing ends, the message M1003 (printing-parallel maintenance operation stop) is received before the ink removal suction operations (i.e., all of the steps) end.

When the printing of the first page is shorter than the ink removal suction operations, the branch processing of FIG. 14 is performed. In step S1317 of FIG. 14, the sub task 601 determines whether or not the message received from the main task 600 is the message M1004 (printing-parallel maintenance operation end standby). Here, because the message M1003 has been received, it is determined that the message is not the message M1004, and the sequence moves to step S1321.

In step S1321, the sub task 601 determines whether or not the message received from the main task 600 is the message M1003 (printing-parallel maintenance operation stop). Here, the message M1003 has been received, and the sequence therefore moves to step S1322.

In step S1322, the sub task 601 completes the execution of the steps of the ink removal suction operations. In step S1323, the sub task 601 updates the parameter in the ink removal suction operation progress table 1200. For example, of the step numbers in step 1101 of the ink removal suction operation sequence table 1100, the CPU 120 obtains the next step number after an already-executed step. The CPU 120 then updates sequence progress 1201 in the ink removal suction operation progress table 1200 on the basis of the obtained step number. FIG. 12B is a diagram illustrating an example in which the value of sequence progress 1201 has been updated. In step S1324, the sub task 601 sends the reply M1005 to the main task 600, after which the sequence moves to step S1312.

Then, in step S1312, the sub task 601 receives the message M1002 (printing-parallel maintenance inactive) from the main task 600, and thus after step S1313, it is determined that the message M1002 has been received in step S1326. The processing of the sub task 601 then ends, and the printing of the first page ends as well.

Processing for the second page will be described next.

When printing starts, the sub task 601 is launched in the same manner as with the first page. Steps S1301 to S1304 are the same as described for the first page. Additionally, if it is determined in step S1304 that the value of the parameter of the cap-retained ink counter 300, indicating the amount of ink, exceeds the predetermined threshold, the processing up to step S1310 is the same as described for the first page.

If it is determined that the amount of ink of the cap-retained ink counter 300 does not exceed the predetermined threshold, the sequence moves to step S1314. In step S1314, the sub task 601 refers to the ink removal suction operation progress table 1200, and in step S1315, determines whether or not there is a value stored in the parameter in the ink removal suction operation progress table 1200. Here, if the value stored in the ink removal suction operation progress table 1200 is a value aside from the initial value, it is determined that a value is stored. The sequence moves to step S1316 if it is determined that there is no value stored. The processing after step S1316 is the same as described for the first page. On the other hand, the sequence moves to step S1308 if it is determined that there is a value stored in the parameter of sequence progress 1201 in the ink removal suction operation progress table 1200.

A case where it is determined that there is a value stored in the parameter of sequence progress 1201 in the ink removal suction operation progress table 1200 will be described here.

In step S1308, the sub task 601 executes a step of the ink removal suction operations on the basis of the value in sequence progress 1201. The processing up to step S1310 is the same as described for the first page. In step S1310, the sub task 601 determines whether or not all of the steps of the ink removal suction operations have ended. A case where all the steps of the ink removal suction operations have not ended, and no message has been received from the main task 600, is the same as the descriptions given for the first page.

If the printing of the second page is longer than the ink removal suction operations, the execution of all the steps of the ink removal suction operations will end before the message from the main task 600 is received, and the sequence therefore moves from step S1310 to step S1311. On the other hand, if the printing of the second page in the printing of two pages is shorter than the ink removal suction operations, the message M1004 (printing-parallel maintenance operation end standby) is received from the main task 600, as described for the main task 600 with reference to FIGS. 8A and 8B. The sequence therefore moves from step S1317 to step S1318 in FIG. 14.

A case where the printing of the second page is longer than the ink removal suction operations will be described.

As described with reference to FIGS. 8A and 8B, in the processing performed when the printing of the second page in two pages of printing ends, the message M1004 (printing-parallel maintenance operation end standby) and the message M1002 (printing-parallel maintenance inactive) are received from the main task 600 in that order after the end of all of the steps of the ink removal suction operations.

In step S1311, the sub task 601 clears the values of the parameters in the ink removal suction operation progress table 1200. For example, the CPU 120 sets the value of sequence progress 1201 in the ink removal suction operation progress table 1200 to the initial value (e.g., zero).

In step S1312, the sub task 601 confirms that either of the following conditions is satisfied: that a message sent from the main task 600 has been received; or that the parameter of the cap-retained ink counter 300, indicating the amount of ink, has been added. The sequence moves to step S1313 if it is confirmed that either of the conditions is satisfied. In step S1313, the sub task 601 determines whether the confirmed condition is that the value of the parameter of the cap-retained ink counter 300, indicating the amount of ink, has been added.

Here, if it is determined that the confirmed condition is that the value of the parameter of the cap-retained ink counter 300, indicating the amount of ink, has been added, the processing is repeated from step S1303. On the other hand, if it is determined that the confirmed condition is that the message sent from the main task 600 has been received, the sequence moves to step S1326.

In step S1326, the sub task 601 determines whether or not the message received from the main task 600 is the message M1002 (printing-parallel maintenance inactive).

As described for the processing of the main task 600 with reference to FIGS. 8A and 8B, in the processing performed when the printing of the second page in two pages of printing ends, the message M1004 (printing-parallel maintenance operation end standby) and the message M1002 (printing-parallel maintenance inactive) are received from the main task 600 in that order after the end of (all of the steps of) the ink removal suction operations. As such, the message M1004 is received first, and the sequence therefore moves to step S1327.

In step S1327, the sub task 601 determines whether the message received from the main task 600 is the message M1003 (printing-parallel maintenance operation stop) or the message M1004 (printing-parallel maintenance operation end standby). Here, the message received from the main task 600 is the message M1004 (printing-parallel maintenance operation end standby), and the sequence therefore moves to step S1312.

In step S1312, the sub task 601 receives the message M1002 (printing-parallel maintenance inactive) from the main task 600, and thus after step S1313, it is determined that the message M1002 has been received in step S1326. The processing of the sub task 601 then ends, and the printing of the second page ends as well.

A case where the printing of the second page is shorter than the ink removal suction operations will be described next.

When the printing of the second page is shorter than the ink removal suction operations, the branch processing of FIG. 14 is performed from step S1310. In step S1317 of FIG. 14, the sub task 601 determines whether or not the message received from the main task 600 is the message M1004 (printing-parallel maintenance operation end standby). In the processing performed when the printing of the second page in two pages of printing ends, the message M1004 (printing-parallel maintenance operation end standby) is received before all of the steps of the ink removal suction operations end, and the sequence therefore moves to step S1318.

In step S1318, the sub task 601 completes the execution of the remaining steps of the ink removal suction operations. Then, in step S1319, the sub task 601 clears the values of the parameters in the ink removal suction operation progress table 1200. For example, the CPU 120 sets the value of sequence progress 1201 in the ink removal suction operation progress table 1200 to the initial value (e.g., zero). In step S1320, the sub task 601 sends the reply M1005 to the main task 600, after which the sequence moves to step S1312.

Then, in step S1312, the sub task 601 receives the message M1002 (printing-parallel maintenance inactive) from the main task 600, and thus after step S1313, it is determined that the message M1002 has been received in step S1326. The processing of the sub task 601 then ends, and the printing of the second page ends as well.

Steps S1308 to S1311 correspond to the printing-parallel maintenance operation of steps S704 and S713 in FIG. 7. Likewise, steps S1322 and S1323 correspond to the suspension operation of step S706 in FIG. 7, and steps S1318 and S1319 correspond to the completion of the printing-parallel maintenance operation in step S715 in FIG. 7.

As described above, according to the present embodiment, the printing-parallel maintenance operation is broken down into a plurality of steps and executed. If the printing of one page is shorter than the ink removal suction operations, and there is a subsequent page (e.g., a second page), control is performed such that the step of the printing-parallel maintenance operation being performed at that time is completed but the subsequent steps are not executed. The remaining steps of the printing-parallel maintenance operation are performed in parallel with the printing of the subsequent page. Such a configuration makes it possible to prevent a situation where the overall progress of print processing is delayed due to the printing-parallel maintenance operation.

Third Embodiment

The following will describe areas that are different from the first and second embodiments. The present embodiment will describe processing performed when printing is canceled partway through continuous printing. When printing is canceled partway through continuous printing, ink will remain within the cap 233, or the ink removal suction operations will be in a suspended state, for example. As an example, the present embodiment will describe processing performed when printing is canceled after the printing of the first page of two pages has ended. In the present embodiment, upon receiving a cancellation instruction, the main task 600 sends the message M1003 (printing-parallel maintenance operation stop) to the sub task 601. At this time, if the printing-parallel maintenance operation is underway, the sub task 601 performs a suspension operation such as that described in the first embodiment, or processing for completing the step of the printing-parallel maintenance operation which is underway as described in the second embodiment.

When the processing in step S813 of FIG. 8B is executed, the printing of the first page in step S709 of FIG. 7 ends. If the printing is canceled at this timing, the sub task 601 starts the processing of FIG. 15.

Figure 15:
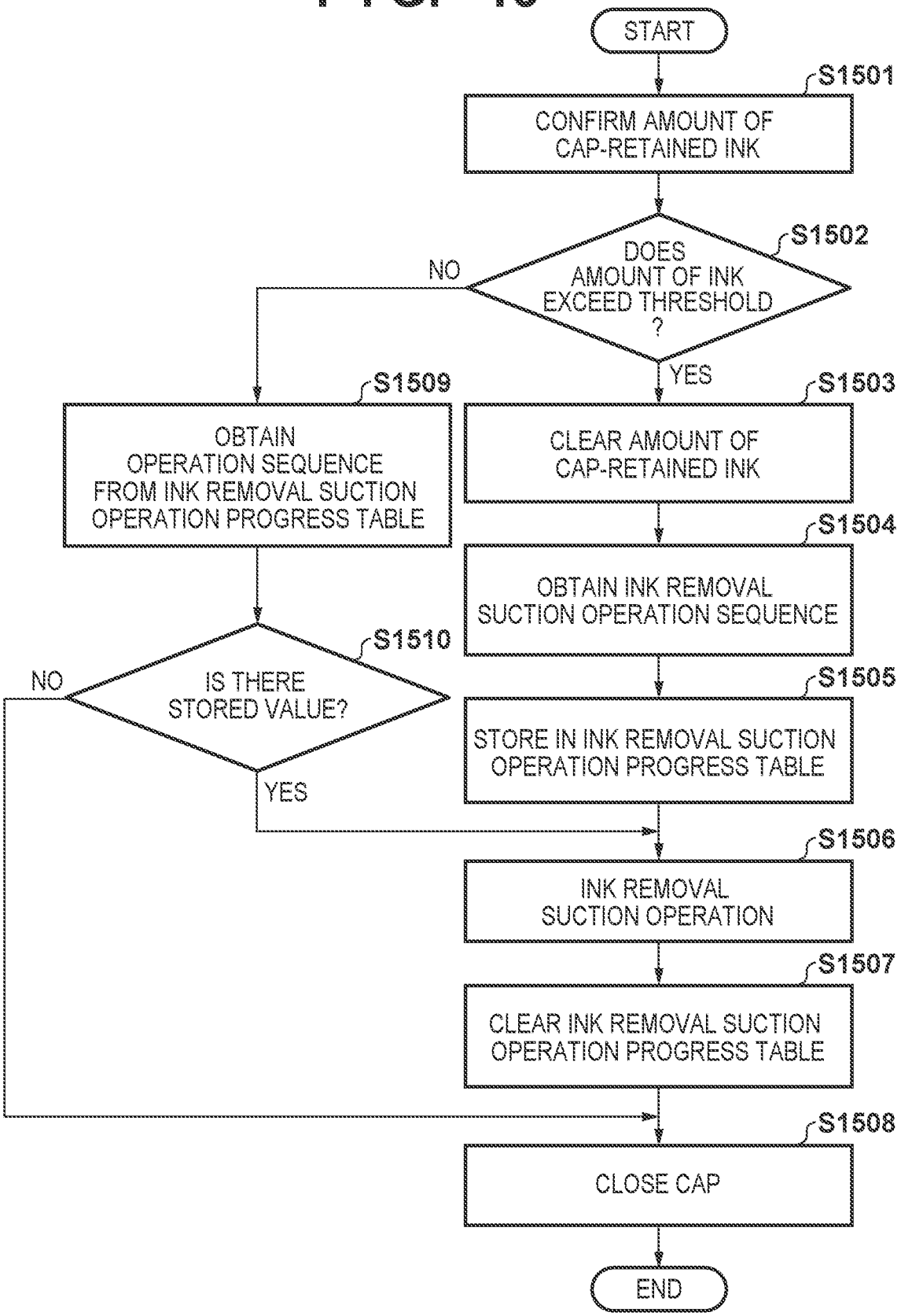
FIG. 15 is a flowchart illustrating sub task processing.

FIG. 15 is a flowchart illustrating processing by the sub task 601. In step S1501, the sub task 601 confirms the amount of ink in the cap 233. For example, the CPU 120 obtains the value of the parameter of the cap-retained ink counter 300 indicating the amount of ink.

In step S1502, the sub task 601 determines whether or not the value of the parameter of the cap-retained ink counter 300, indicating the amount of ink, exceeds a predetermined threshold. The sequence moves to step S1503 if it is determined that the threshold is exceeded. Note that the threshold used in step S1502 may be the same as the threshold used in step S904 of FIG. 9A, or may be different. The sequence moves to step S1509 if it is determined in step S1502 that the threshold is not exceeded. A case where the sequence moves to step S1509 will be described later.

In step S1503, the sub task 601 clears the value of the parameter of the cap-retained ink counter 300 indicating the amount of ink. For example, the CPU 120 sets the value of the parameter of the cap-retained ink counter 300, indicating the amount of ink, to an initial value (e.g., zero).

In step S1504, the sub task 601 obtains values of parameters of an ink removal suction operation sequence. For example, the CPU 120 obtains the values of drive speed 401 and total drive amount 402 from the ink removal suction operation sequence table 400.

In step S1505, the sub task 601 stores the values of the parameters of the ink removal suction operation sequence, obtained in step S1504, in the ink removal suction operation progress table 500.

In step S1506, the sub task 601 executes the ink removal suction operations. For example, the CPU 120 issues a drive command to the motor control unit 134 via the local bus 110 and the device I/O 125 in accordance with the values of the parameters stored in the ink removal suction operation progress table 500 or 1200. Then, by driving the motor 231 under the control of the motor control unit 134 and driving the pump 234 via the drive switching device 232, the ink held in the cap 233 is moved to the waste ink reservoir 235 via the ink flow channel 236. In the present embodiment, the ink removal suction operations of step S1506 are executed to completion rather than being suspended.

In step S1507, the sub task 601 clears the ink removal suction operation progress table 500 or 1200. For example, the CPU 120 sets the value of each of the parameters in the ink removal suction operation progress table 500 or 1200 to an initial value (e.g., zero).

In step S1508, the sub task 601 performs the cap closing operation and ends the cancellation processing of FIG. 15. For example, the CPU 120 instructs the motor control unit 134 to perform the cap closing operation. First, the printing head 212 is driven by the motor 211 to move to the position P1 in FIG. 2. When the motor 231 is driven under the control of the motor control unit 134, the cap 233 is controlled via the drive switching device 232, the printing head 212 is protected by the cap 233, and the printing operations end.

Next, a case where it is determined in step S1502 that the value of the parameter of the cap-retained ink counter 300, indicating the amount of ink, does not exceed the predetermined threshold will be described. In this case, the sequence moves from step S1502 to step S1509.

In step S1509, the sub task 601 refers to the parameters in the ink removal suction operation progress table 500 or 1200. Then, in step S1510, it is determined whether or not there is a value stored in each of the parameters in the ink removal suction operation progress table 500 or 1200. Here, if the value stored in each of the parameters of the ink removal suction operation progress table 500 is a value aside from the initial value, it is determined that a value is stored. If it is determined that a value is stored in each of the parameters in the ink removal suction operation progress table 500 or 1200, the sequence moves to step S1506, where the sub task 601 executes the ink removal suction operations using the values of the drive speed and the drive amount which are stored. Then, the ink removal suction operation progress table 500 or 1200 is cleared in step S1507, the cap closing operation is executed in step S1508, and the cancellation processing of FIG. 15 ends. Note that in step S1506, the ink removal suction operations may be executed using the values of drive speed 401 and total drive amount 402 in the ink removal suction operation sequence table 400, rather than using the values of drive speed 501 and drive amount 502 in the ink removal suction operation progress table 500.

If it is determined in step S1510 that there is not value stored in each of the parameters of the ink removal suction operation progress table 500 or 1200, the sequence moves to step S1508, where the cap closing operation is executed. The cancellation processing of FIG. 15 then ends.

As described above, according to the present embodiment, if ink is present in the cap when printing is canceled partway through continuous printing, the ink removal suction operations can be performed for the ink which is present. Additionally, if ink removal suction operations remain as a result of the printing being canceled, the remaining ink removal suction operations can be performed.

In the foregoing embodiments, the amount of ink is described as the parameter of the cap-retained ink counter 300 indicating the amount of ink in FIGS. 3A and 3B. However, the parameter indicating the amount of ink may be a parameter aside from the amount of ink. For example, a dot count value indicating the ink droplets ejected from the printing head 212 may be stored, as in the case of a cap-retained ink counter 1600 indicated in FIGS. 16A and 16B. In this case, the determination for executing the ink removal suction operations (steps S904, S1304, and S1502) may be made on the basis of the dot count value and a threshold.

Additionally, there are cases where maintenance operations which cannot be performed in parallel with printing (e.g., cleaning the nozzles of the printing head) are performed while printing a plurality of pages. In such a case, the maintenance operations are performed between pages from the outset, and the progress of the overall printing processing will stop temporarily. Therefore, in such a case, if ink removal suction operations are underway when the printing of the previous page (e.g., the first page) ends, those ink removal suction operations may be completed rather than being suspended.

The present invention is not limited to the above embodiments and various changes and modifications can be made within the spirit and scope of the present invention. Therefore, to apprise the public of the scope of the present invention, the following claims are made.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-119452, filed Jul. 10, 2020, which is hereby incorporated by reference herein in its entirety.

What is claimed is:

1. A printing apparatus comprising:

a printing unit configured to print onto a sheet by ejecting ink from a printing head;

a maintenance unit configured to perform a maintenance operation capable of being performed in parallel with the printing performed by the printing unit; and a control unit configured to control the maintenance unit such that when the printing by the printing unit and the maintenance operation by the maintenance unit are performed in parallel, and the maintenance operation is not completed by the time the printing by the printing unit has ended, the maintenance operation is ended without being completed.

2. The printing apparatus according to claim 1, wherein the control unit controls the maintenance unit to suspend the maintenance operation if the maintenance operation is not completed by the time the printing by the printing unit has ended.

3. The printing apparatus according to claim 1, wherein the maintenance operation is performed as an operation having a plurality of steps, and if the maintenance operation is not completed by the time the printing by the printing unit has ended, the control unit controls the maintenance unit to complete a step of the maintenance operation being performed in parallel with the printing by the printing unit and not perform a subsequent step.

4. The printing apparatus according to claim 1, wherein when the printing unit prints a plurality of pages and there is a subsequent page to be printed at the time the printing by the printing unit has ended, the control unit controls the maintenance unit to end the maintenance operation without completing the maintenance operation.

5. The printing apparatus according to claim 4, wherein the control unit controls the maintenance unit to perform a remaining maintenance operation, aside from the maintenance operation that has been ended, in parallel with printing of the subsequent page.

6. The printing apparatus according to claim 4, wherein when there is no subsequent page to be printed at the time the printing by the printing unit has ended, the control unit controls the maintenance unit to complete the maintenance operation.

7. The printing apparatus according to claim 6, wherein a case where there is no subsequent page to be printed at the time the printing by the printing unit has ended includes a case where the printing by the printing unit has been canceled.

8. The printing apparatus according to claim 1, wherein the maintenance unit includes:

a cap configured to receive ink flushed from the printing head; and a pump that sends ink held in the cap to a waste ink reservoir, wherein the control unit controls the maintenance unit to send the ink held in the cap to the waste ink reservoir by causing the pump to operate.

9. The printing apparatus according to claim 8, further comprising:

a first storage unit configured to store a parameter indicating an amount of ink held in the cap.

10. The printing apparatus according to claim 9, wherein the parameter indicating the amount of ink held in the cap includes a dot count indicating the amount of ink.

11. The printing apparatus according to claim 9, wherein the control unit causes the pump to operate when, on the basis of the parameter stored in the first storage unit, the amount of ink held in the cap exceeds a threshold.

12. The printing apparatus according to claim 8, wherein the control unit controls driving of a motor that causes the pump to operate.

13. The printing apparatus according to claim 12, further comprising:

a second storage unit configured to store a parameter pertaining to the driving of the motor.

14. The printing apparatus according to claim 13, wherein the parameter pertaining to the driving of the motor includes at least one of a drive speed and a drive amount.

15. A control method executed by a printing apparatus, the printing apparatus including a printing unit configured to print onto a sheet by ejecting ink from a printing head and a maintenance unit configured to perform a maintenance operation capable of being performed in parallel with the printing performed by the printing unit, the method comprising:

controlling the maintenance unit such that when the printing by the printing unit and the maintenance operation by the maintenance unit are performed in parallel, and the maintenance operation is not completed by the time the printing by the printing unit has ended, the maintenance operation is ended without being completed.

* * * * *